US006422559B1

(12) United States Patent
Utkin

(10) Patent No.: US 6,422,559 B1
(45) Date of Patent: Jul. 23, 2002

(54) ROTATABLE CONNECTED OBJECT

(76) Inventor: Valeriy Utkin, 39 Lee Rd., Livingston, NJ (US) 07039

( * ) Notice: Subject to any disclaimer, the term of this patent is extended or adjusted under 35 U.S.C. 154(b) by 45 days.

(21) Appl. No.: 09/638,264

(22) Filed: Aug. 15, 2000

(51) Int. Cl.[7] ..... A63F 9/08
(52) U.S. Cl. ..... 273/153 S; 74/29
(58) Field of Search ..... 273/153 S; 74/29, 74/30, 31, 32, 33, 34, 35

(56) References Cited

U.S. PATENT DOCUMENTS 4,378,117 A * 3/1983 Rubik
4,441,715 A * 4/1984 Titus
4,484,744 A 11/1984 Gmiinder ..... 273/153
4,522,401 A 6/1985 Gustafson ..... 273/153
4,886,273 A * 12/1989 Unger
4,889,340 A * 12/1989 Greene
5,074,562 A * 12/1991 Green
5,251,899 A * 10/1993 Reed
5,308,066 A * 5/1994 Pataki et al.
5,386,993 A 2/1995 Apsan ..... 273/153
5,452,895 A * 9/1995 Ray
5,566,941 A * 10/1996 Destics

* cited by examiner

*Primary Examiner*—Paul T. Sewell
*Assistant Examiner*—Nini Legesse
(74) *Attorney, Agent, or Firm*—Walter J. Tencza, Jr.

(57) ABSTRACT

An apparatus is provided comprising a plurality of sections together forming a connected object, which may be a sphere. One half of the sphere can be rotated with respect to another half of the sphere in various planes or along various circular paths. In one embodiment the sphere has eight sections and can be rotated along any one of three different circular paths, A, B, and C. The plurality of sections may include first, second, third, fourth, fifth, sixth, seventh, and eighth sections. Each section may be joined to an adjacent section by a connector or in one embodiment by two connectors. Each connector may allow each section to rotate with respect to other sections. A plurality of connectors including twenty-four connectors for connecting eight sections may be provided. Each connector may be comprised of first and second curved rails and a first gear.

17 Claims, 16 Drawing Sheets

ROTATABLE CONNECTED OBJECT

FIELD OF THE INVENTION

This invention relates to games such as the Rubik's cube (Trademarked) and other games.

BACKGROUND OF THE INVENTION

Various devices and apparatus are known in the art for providing puzzles where pieces are rotated in various ways.

SUMMARY OF THE INVENTION

The present invention in one embodiment provides an apparatus comprising a plurality of sections together forming a rotatable connected object, which may for example be a sphere. One half of the sphere can be rotated with respect to another half of the sphere in various planes in or along various circular paths. In one embodiment the sphere has eight sections and can be rotated along any one of three different circular paths, A, B, and C.

The plurality of sections may include first, second, third, fourth, fifth, sixth, seventh, and eighth sections. Each section may be joined to an adjacent section by a connector or in one embodiment by two connectors. Each connector may allow each section to rotate with respect to other sections. A plurality of connectors including twenty-four connectors for connecting eight sections may be provided.

Each connector may be comprised of first and second curved rails and a first gear. The first gear may be connected to the first and second curved rails. Each section may be comprised of a rail channel and a gear channel. The first and second curved rails of each connector may fit into the rail channels of each section. The first gear of the each connector may fit into a combination channel comprised of a gear channel of one section and the gear channel of an adjacent section.

The first and second curved rails of each connector may be connected to a first shaft of each connector. The first gear of each connector may be a conical gear which can rotate about the first shaft of each connector. The gear channel of the each section may include ridges which interact with the first gear of each connector when the particular section is moved with respect to an adjacent section.

Each section may have a top surface. The rail channel and gear channel of each section may lie beneath the top surface of the corresponding section and within the sphere when the plurality of sections are put together to form the sphere. The connected object may have different surfaces which may make the connected sphere appear unlike a sphere on the connected object surface. However, the rail channels and gear channels will typically form an inner sphere.

In one embodiment, the sphere can be put in a first configuration where: first and second connectors join the first section to the second section; third and fourth connectors join the first section to the third section; fifth and sixth connectors join the first section to the sixth section; seventh and eighth connectors join the second section to the fifth section; ninth and tenth connectors join the second section to the fourth section; eleventh and twelfth connectors join the third section to the fourth section; thirteenth and fourteenth connector joins the third section to the seventh section; fifteenth and sixteenth connectors join the fourth section to the eighth section; seventeenth and eighteenth connectors joins the fifth section to the sixth section; nineteenth and twentieth connectors join the fifth section to the eighth section; twenty-first and twenty-second connectors joins the sixth section to the seventh section; and the twenty-third and twenty-fourth connectors joins the seventh section to the eighth section.

A half of the sphere comprised of the first, third, seventh, and sixth sections can be rotated ninety degrees along a circle A with respect to a half of the sphere comprised-of the second, fourth, eighth, and fifth sections to change the sphere from the first configuration to a second configuration. In the second configuration, the connectors along the circle A have changed in position one half of a section arc length from the first configuration. The other connectors remain in the same position with respect to the sections they connect.

A half of the sphere comprised of the first, second, fourth, and third sections can be rotated ninety degrees along a circle B with respect to a half of- the sphere comprised of the fifth, seventh, eighth, and sixth sections to change the sphere from the first configuration to a third configuration. In the third configuration, the connectors along the circle B have changed in position one half of a section arc length from the first configuration. The other connectors remain in the same position with respect to the sections they connect.

A half of the sphere comprised of the third, fourth, eighth, and seventh sections can be rotated ninety degrees along a circle C with respect to a half of the sphere comprised of the first, second, fifth, and sixth sections to change the sphere from the first configuration to a fourth configuration. In the fourth configuration, the connectors along the circle C have changed in position one half of a section arc length from the first configuration. The other connectors remain in the same position with respect to the sections they connect.

DETAILED DESCRIPTION OF THE DRAWINGS

Figure 1A:
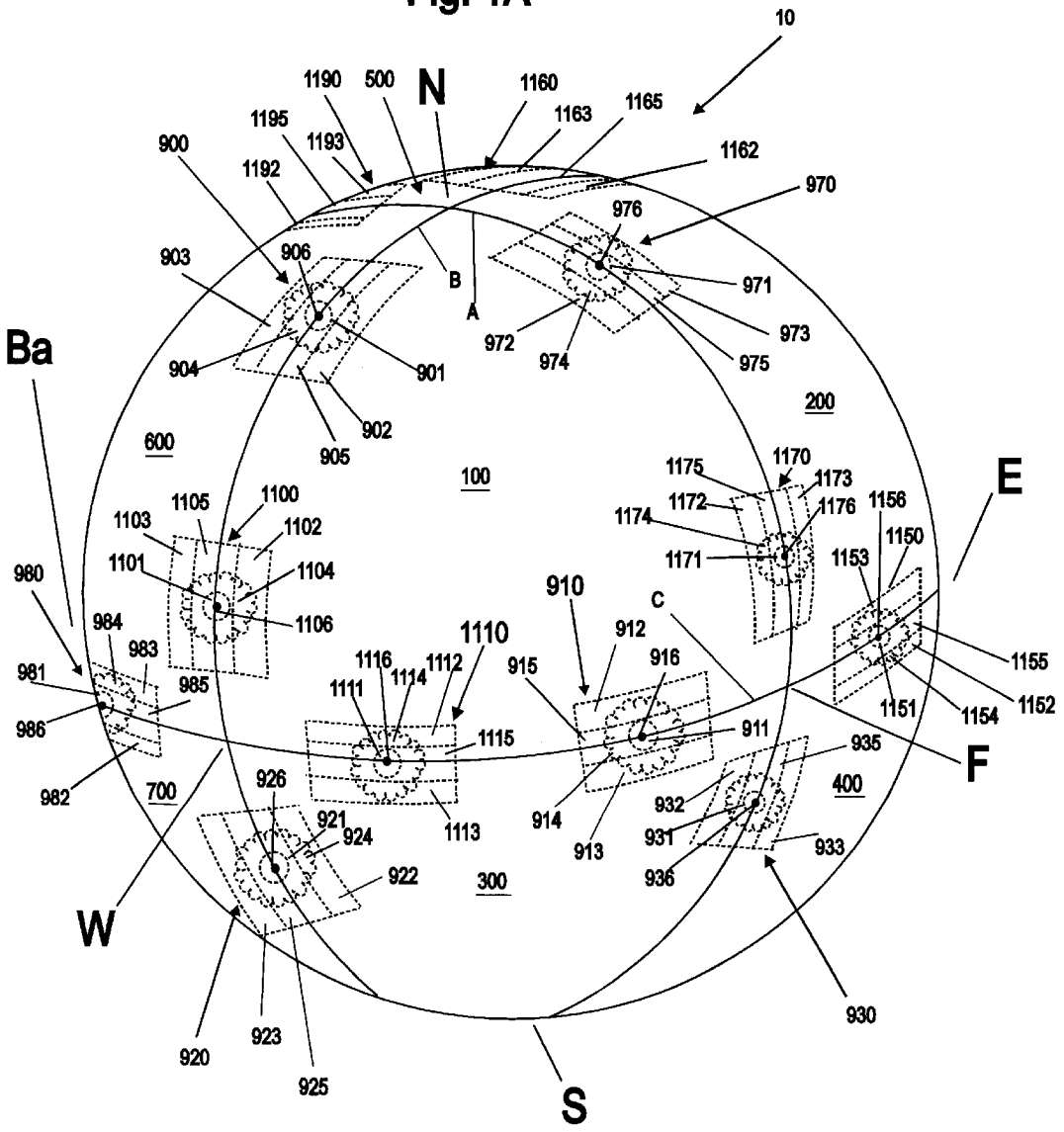
FIG. 1A shows a front perspective view of a first sphere in accordance with an embodiment of the present invention with the sphere in a first configuration.
Figure 1B:
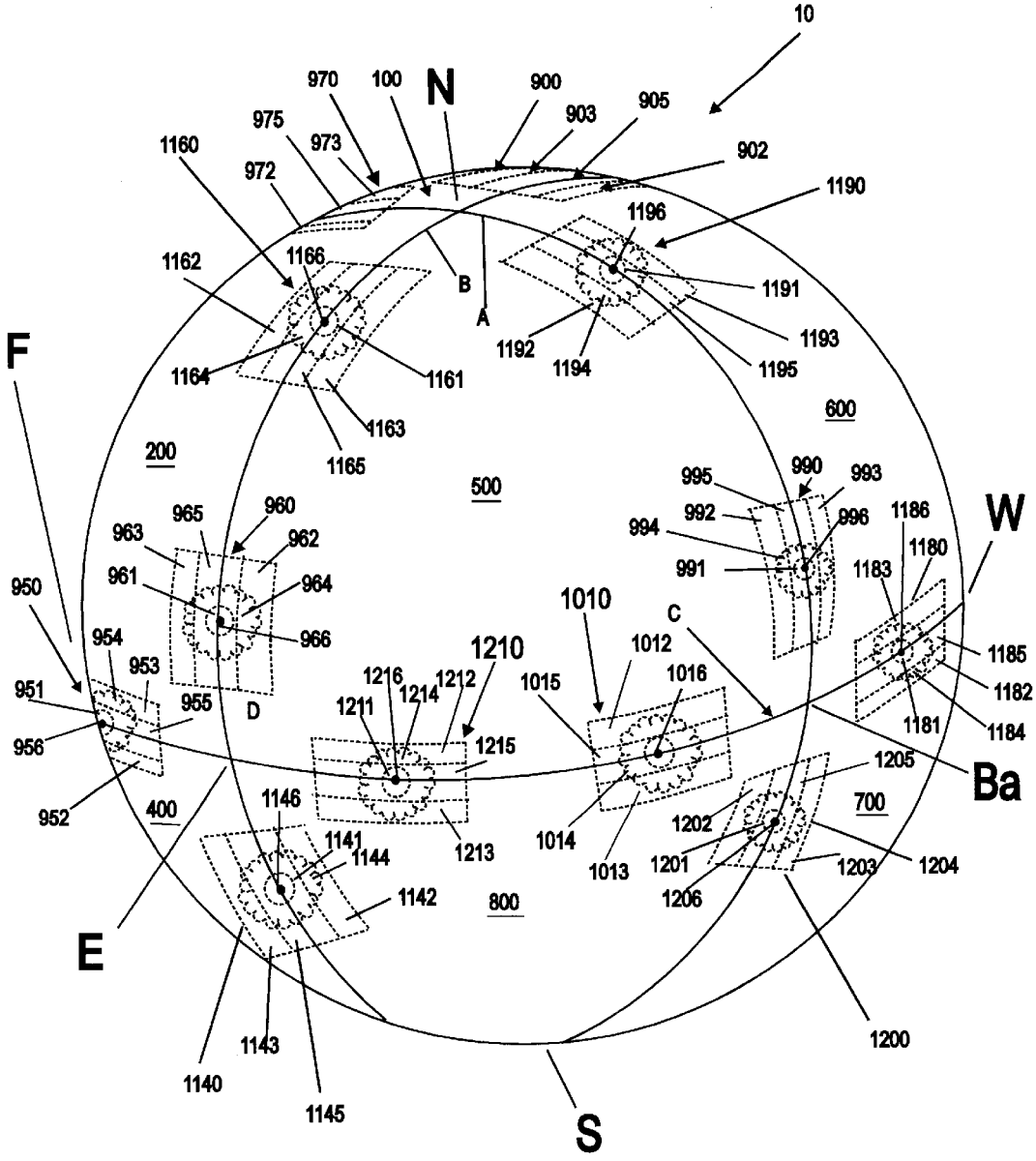
FIG. 1B shows a rear perspective view of the sphere of FIG. 1A in the first configuration.

FIG. 1A shows a front perspective view of a first sphere 10 in accordance with an embodiment of the present invention with the first sphere 10 in a first configuration. FIG. 1B shows a rear perspective view of the first sphere 10 in the first configuration. The first sphere 10 is comprised of eight sections: 100, 200, 300, 400, 500, 600, 700, and 800. In the example of FIGS. 1A–1B, the sphere 10 could be thought of conceptually as being cut by three planes which are traversed by circles A, B, and C, respectively. In another embodiment, the first sphere 10 could be divided further into, for example, thirty-two sections by being cut conceptually by six planes, similar to a icosidodecahedron. The first sphere 10 is further comprised of twenty-four connectors: 900, 910, 920, 930, 940, 950, 960, 970, 980, 990, 1000, 1010, 1100, 1110, 1120, 1130, 1140, 1150, 1160, 1170, 1180, 1190, 1200, and 1210, which connect various sections of the sections 100 through 800 together as will be described.

Figure 2A:
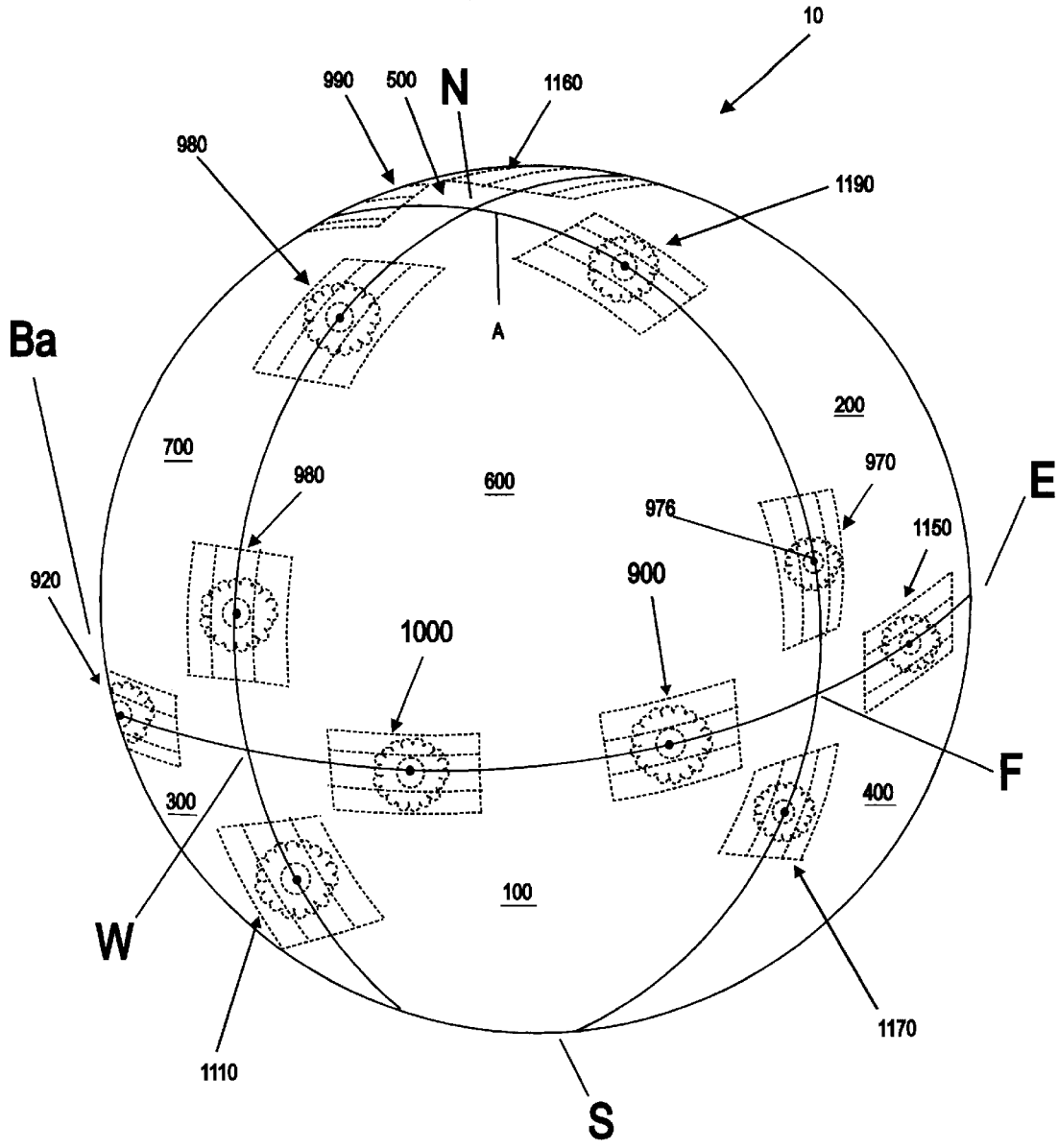
FIGS. 2A and 2B show front and rear perspective views of the first sphere in a second configuration.
Figure 2B:
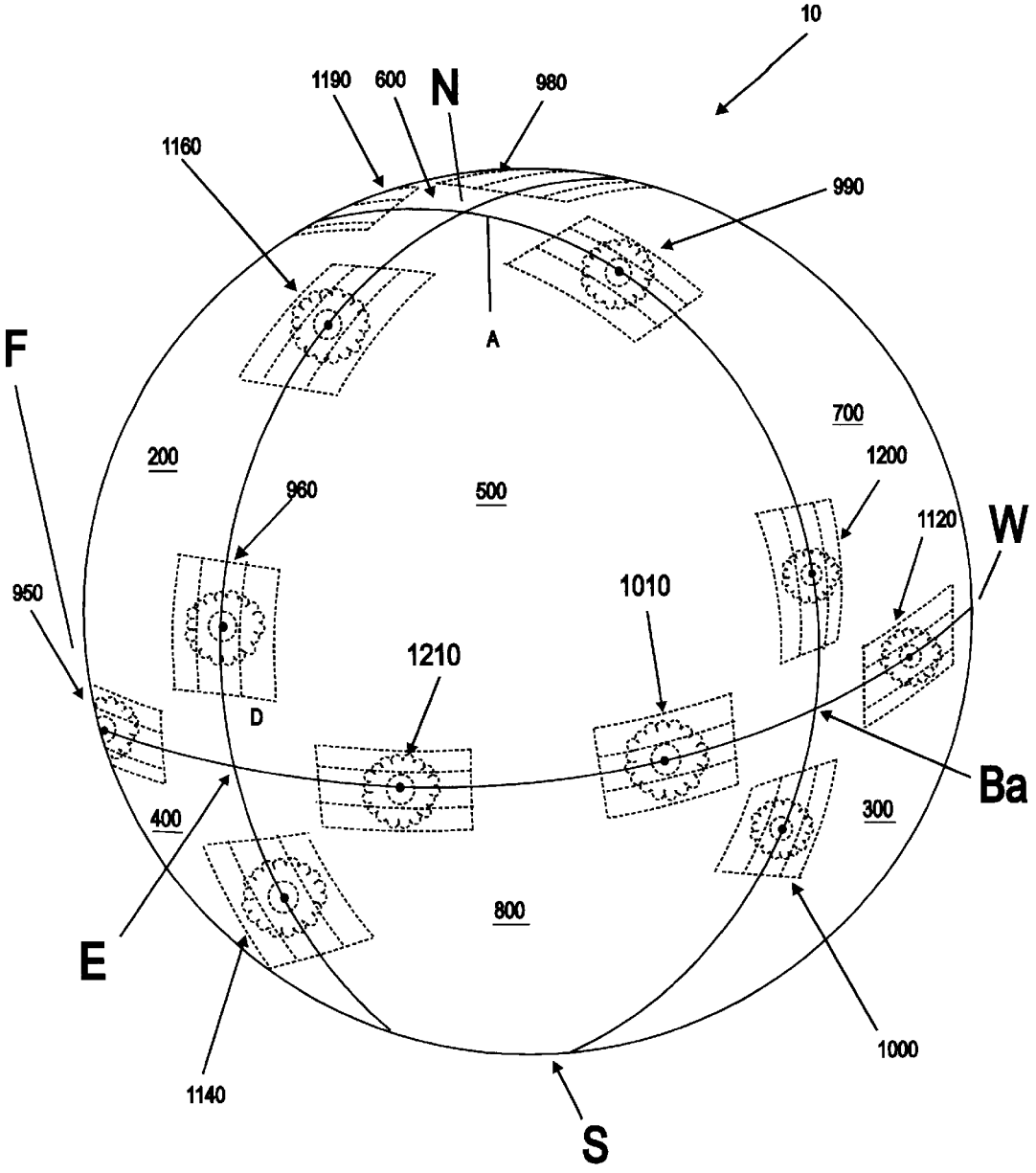
Figure 3A:
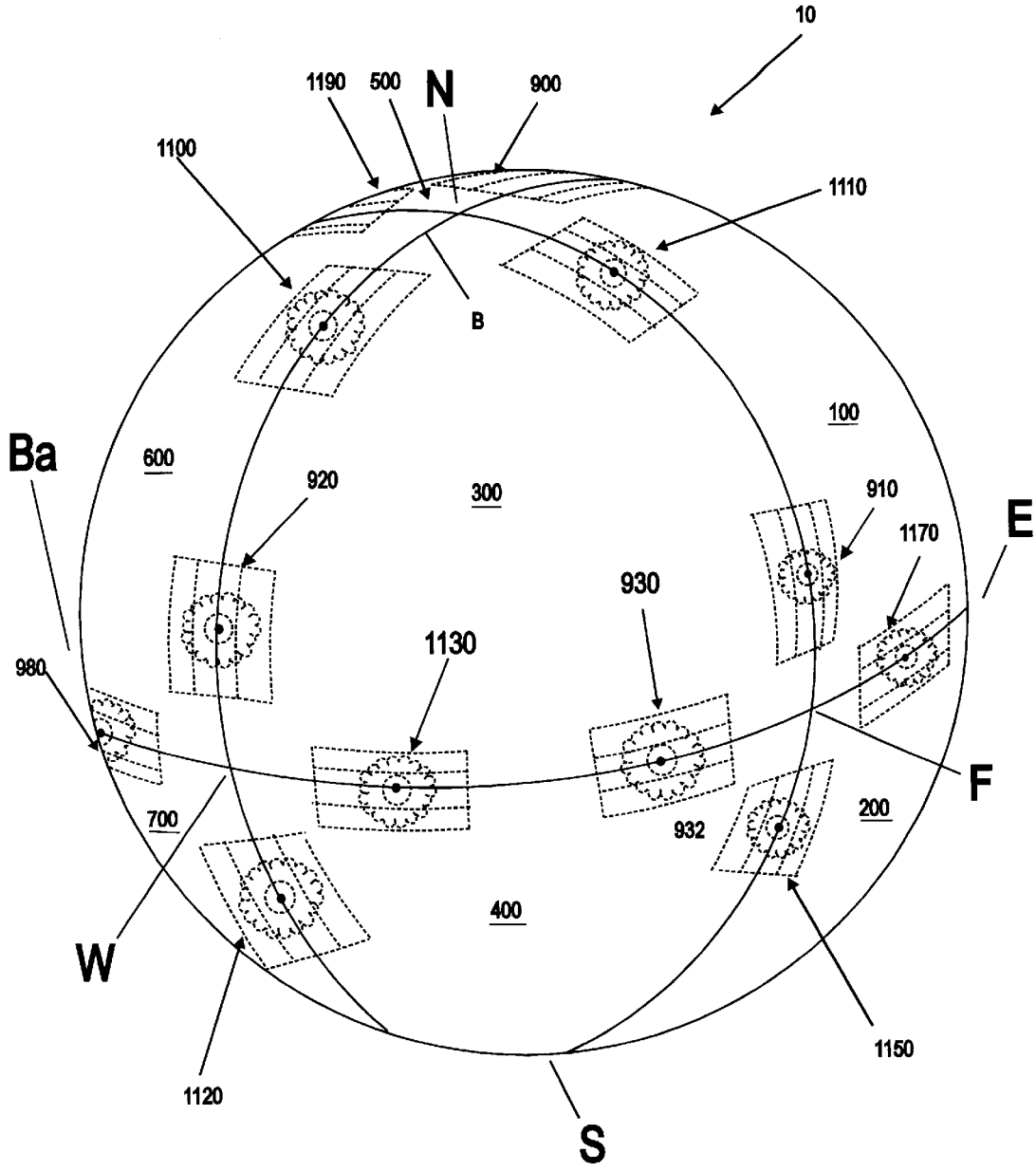
FIGS. 3A and 3B show front and rear perspective views of the first sphere in a third configuration.
Figure 3B:
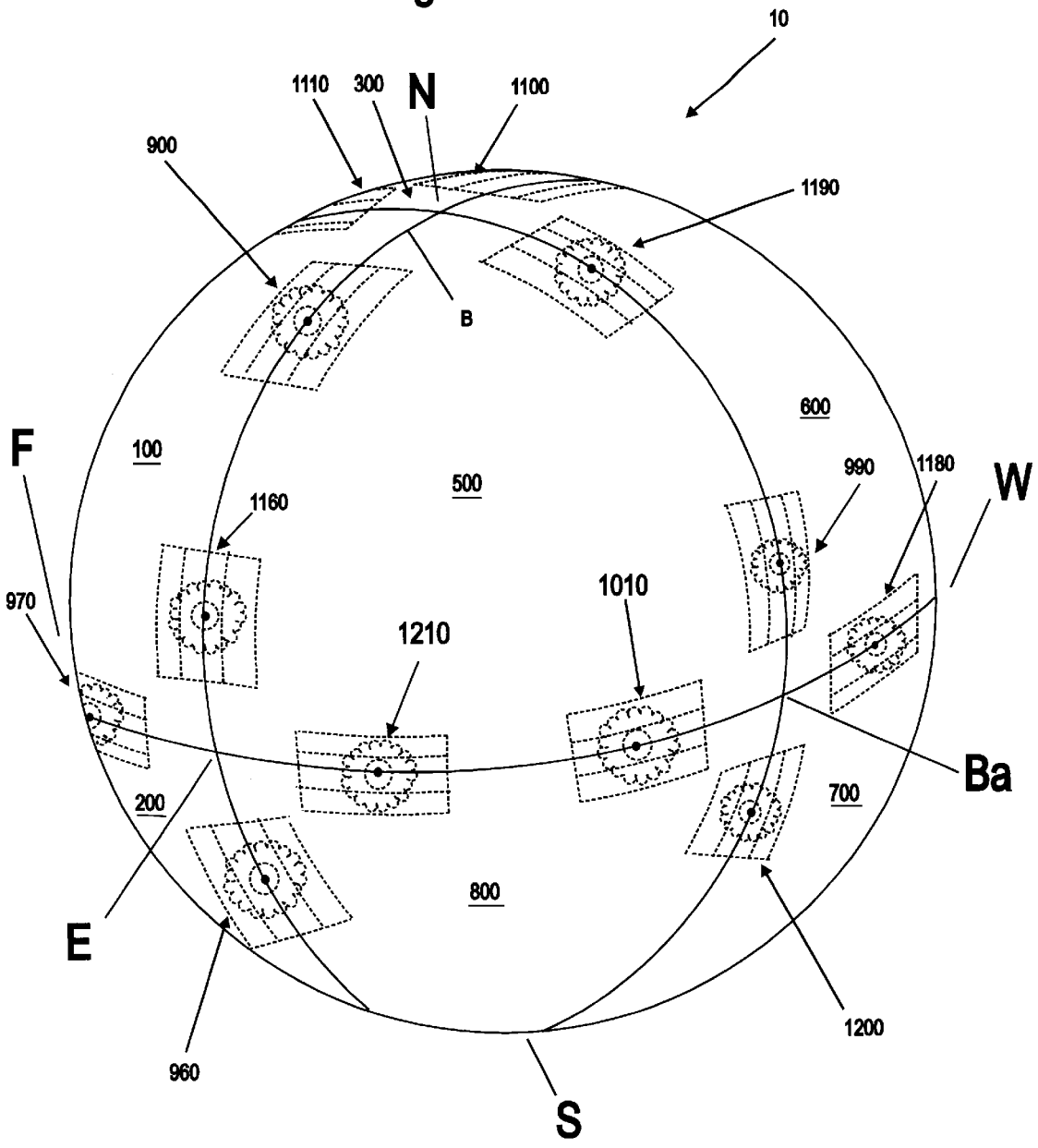
Figure 4A:
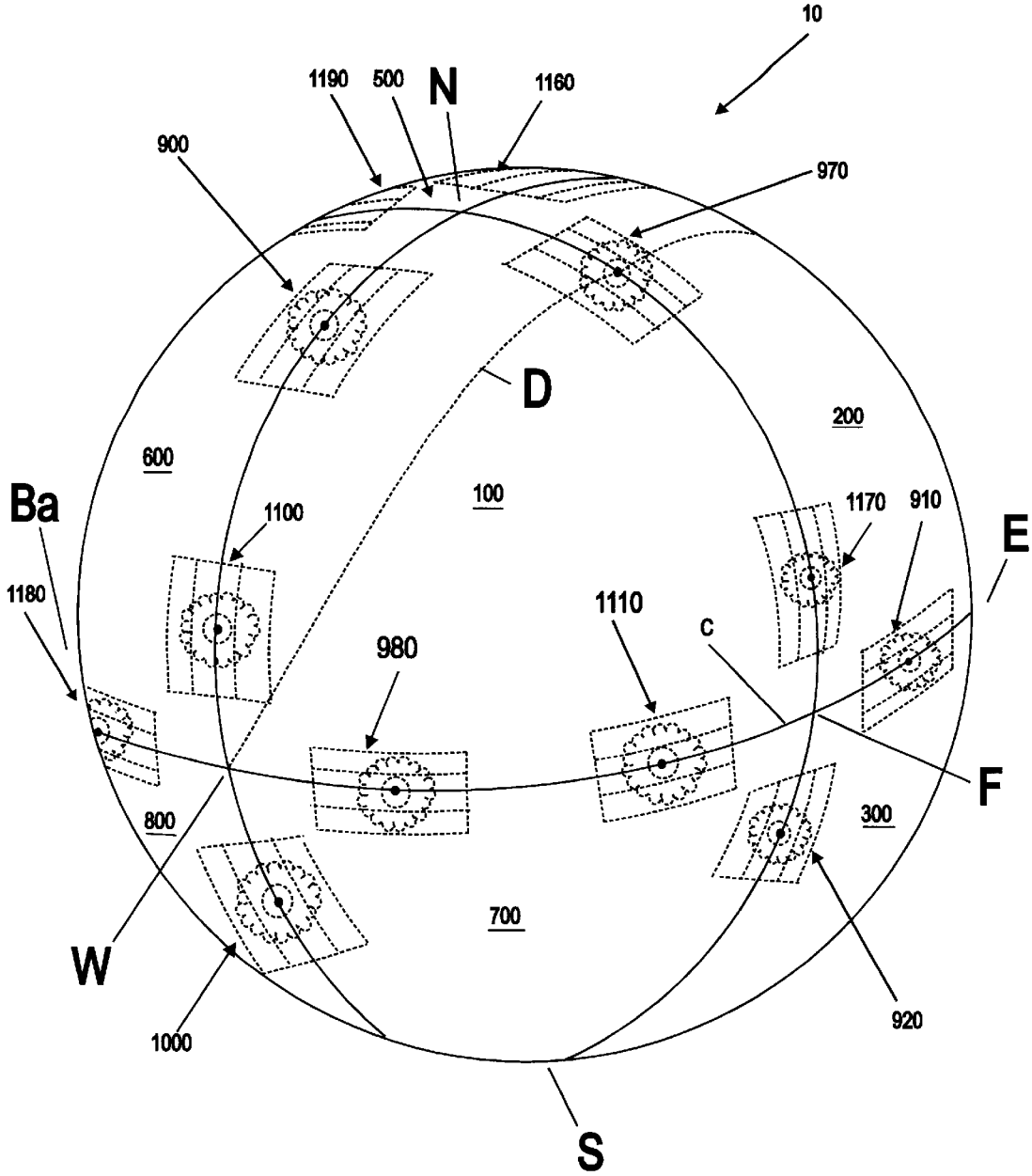
FIGS. 4A and 4B show front and rear perspective views of the first sphere in a fourth configuration.
Figure 4B:
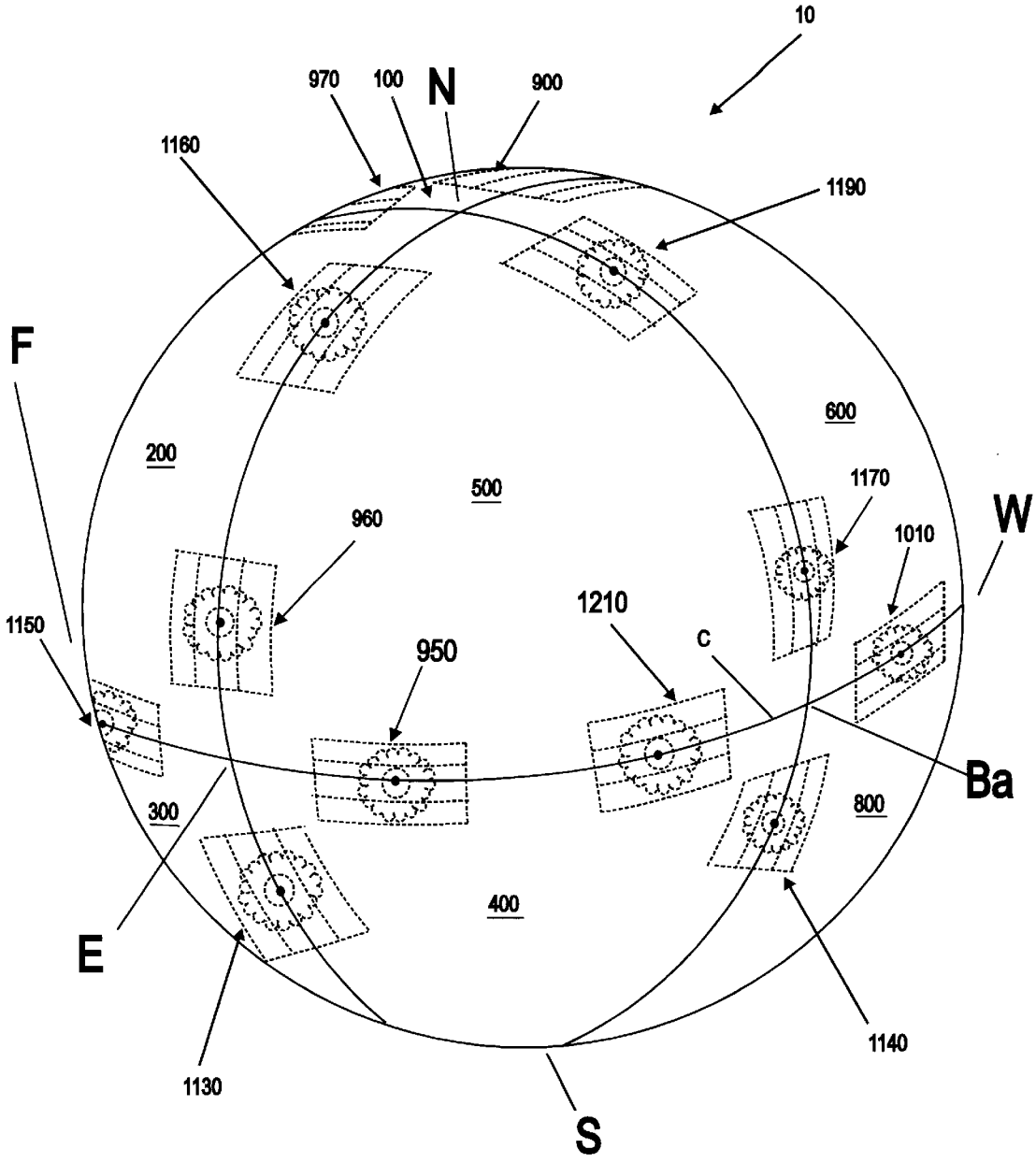

The sections 100, 200, 300, 400, 500, 600, 700, and 800 of the sphere 10 in FIGS. 1A and 1B can be rotated with respect to one another in three rotational directions or dimensions as will be described. The sections 100–800 of sphere 10 can be rotated with respect to one another along the circle A, along the circle B, or along the circle C shown in FIGS. 1A and 1B. FIGS. 2A and 2B show the sphere 10 in a second configuration after half of the sphere 10 has been rotated with respect to another half of the sphere about circle A. FIGS. 3A and 3B show the sphere 10 in a second configuration after half of the sphere 10 in the configuration of FIGS. 1A–1B has been rotated with respect to another half of the sphere about circle B. FIGS. 4A and 4B show the sphere 10 in a third configuration after half of the sphere 10 in the configuration of FIGS. 1A–1B has been rotated with respect to another half of the sphere about circle C.

FIGS. 1A–4B also show poles N, E, W, S, F, and Ba.

In the first configuration of FIGS. 1A and 1B, in FIG. 1A, sections 100 and 200 are shown next to each other on the top of the sphere 10 above the circle C, while the sections 300 and 400 are shown next to each other on the bottom of the sphere 10. Sections 500 and 600 are also shown on the top of the sphere 10, while sections 700 and section 800 (shown in FIG. 1B) are on the bottom of the sphere 10. In FIG. 1A, connectors 900 and 1100 hold sections 600 and 100 together, connectors 910 and 1110 hold sections 100 and 300 together, connectors 920 and 1120 (shown by FIGS. 6A and 6B) hold sections 700 and 300 together, connectors 930 and 1130 (shown by FIGS. 5A and 5B) hold sections 300 and 400 together, connectors 940 (shown by FIGS. 6A and 6B) and 1140 hold sections 400 and 800 together (shown in FIG. 1B), connectors 950 (shown by FIG. 1B) and 1150 hold sections 200 and 400 together; connectors 960 and 1160 hold sections 500 and 200 together (shown by FIG. 1B), connectors 970 and 1170 hold sections 100 and 200 together, connectors 980 (shown in FIG. 1A) and 1180 (shown by FIG. 1B) hold sections 600 and 700 together, connectors 990 and 1190 (shown by FIG. 1B) hold sections 500 and 600 together, connectors 1000 (shown by FIGS. 5A and 5B) and 1200 (shown by FIG. 1B) holds sections 700 and 800 together (shown in FIG. 1B) and connectors 1010 and 1210 hold sections 500 and 800 together (shown by FIG. 1B).

To change the sphere 10 from the first configuration of FIGS. 1A and 1B to the second configuration of FIGS. 2A and 2B, the half of the sphere 10 including sections 600, 100, 300 and 700 is rotated ninety degrees along the circle A of FIG. 1, with respect to the half of the sphere 10 including sections 200, 400, 800, and 500. The half of the sphere 10 (sections 600, 100, 300, and 700) could be rotated any multiple of ninety degrees to form a new configuration for sphere 10, such as one hundred eighty degrees, or two hundred seventy degrees). The ninety degree rotation causes section 100 to move from the top of the sphere 10 in FIG. 1A to the bottom of the sphere 10 in FIGS. 2A and 2B, section 300 to move to the back bottom of the sphere 10 as viewed in FIGS. 2A and 2B (the back of FIG. 2A, shown in FIG. 2B), section 700 to move to the top of the sphere 10, and section 600 to move to the front top of the sphere 10 as viewed in FIG. 2A. When the sections 600, 100, 300 and 700 were rotated ninety degrees with respect to sections 200, 400, 800, and 500, the connectors along the circle A (i.e. the circular direction of rotation) were moved half the section side arc length of a section (of sections 100-800).

The section side arc length is the arc length from one pole to any of its adjacent poles. For example, the section side arc length is equal to the arc length from the pole "N" to the pole "F" in FIG. 1A. Connector 970 has a center point 976 which lies on the circle A. The center point 976 is at a distance of ¼ of the section side arc length from the north pole "N" in FIG. 1A. When sphere 10 is changed from the configuration of FIGS. 1A–1B to the configuration of FIGS. 2A–2B, the connector 970 moves so that in FIG. 2A the center point 976 is at a distance of ¼ of the section side arc length from the front pole "F". The connector 970 has thus moved ½ of a section side arc length with the ninety degree rotation. Thus in a sense, while the sections 100, 300, 700, and 600 have moved a full section side arc length from FIGS. 1A–B to FIGS. 2A–B, the connectors along line A have only moved % of a section side arc length. Connectors 1170, 930, 1130, 1000, 1200, 990, and 1190 which are on circle A, move in a similar manner to connector 970 as shown by FIGS. 2A and 2B.

In the second configuration of FIGS. 2A and 2B, along circular line A, connectors 1190 and 970 hold sections 600 and 200 together, connectors 1170 and 930 hold sections 100 and 400 together, connectors 990 and 1200 hold sections 700 and 500 together, and connectors 1000 and 930 hold sections 300 and 800 together. The connectors along circular line A have thus changed where they are located with respect to sections that they connect and in some cases now connect different sections together. Other than the connectors along circular line A, the other connectors as shown in FIGS. 2A–2B, continue to join together the same sections that they joined together in FIGS. 1A–1B and those other connectors do not move with respect to the sections that they join together.

To change the sphere 10 from the first configuration of FIGS. 1A and 1B to the third configuration of FIGS. 3A and 3B, the half of the sphere 10 including sections-100, 200, 400 and 300 is rotated ninety degrees along the circle B of FIG. 1A, with respect to the half of the sphere 10 including sections 500, 600, 700, and 800. The half of the sphere 10 (sections 100, 200, 400, and 300) could be rotated any multiple of ninety degrees to form a new configuration for sphere 10, such as one hundred eighty degrees, or two hundred seventy degrees). The ninety degree rotation causes section 100 to move from the top left of the sphere 10 in FIG. 1A to the top right of the sphere 10 in FIGS. 3A and 3B, section 200 to move to the bottom right of the sphere 10 as viewed in FIGS. 3A and 3B, section 400 to move to the bottom left of the sphere 10, and section 300 to move to the front left of the sphere 10 as viewed in FIG. 3A. When the sections 100, 200, 400 and 300 were rotated ninety degrees with respect to sections 500, 600, 700, and 800, the connectors along the circle B (connectors 1120, 920, 1100, 900, 1160, 960, 1140, 940 (i.e. in the circular direction of rotation) were moved half a section side arc length.

In the third configuration of FIGS. 3A and 3B, along circular line B, connectors 1120 and 940 hold sections 400 and 700 together, connectors 1100 and 920 hold sections 300 and 600 together, connectors 900 and 1160 hold sections 100 and 500 together, and connectors 1140 and 960 hold sections 200 and 800 together. The connectors along circular line B have thus changed where they are located with respect to sections that they connect and in some cases now connect different sections together. Other than the connectors along circular line B, the other connectors as shown in FIGS. 3A–3B, continue to join together the same sections that they joined together in FIGS. 1A–1B and those other connectors do not move with respect to the sections that they join together.

To change the sphere 10 from the first configuration of FIGS. 1A and 1B to the third configuration of FIGS. 4A and 4B, the half of the sphere 10 including sections 300, 400, 800 and 700 is rotated ninety degrees along the circle C of FIG. 1A, with respect to the half of the sphere 10 including sections 200, 100, 600, and 500. The half of the sphere 10 (sections 300, 400, 800, and 700) could be rotated any multiple of ninety degrees to form a new configuration for sphere 10, such as one hundred eighty degrees, or two hundred seventy degrees). The ninety degree rotation causes section 700 to move to the front left of the sphere 10, section 300 to move to the bottom front right of the sphere 10, section 400 to move to the back of the sphere 10, and section 800 to move to the back right as seen in FIGS. 4A and 4B. When the sections 300, 400, 800 and 700 were rotated ninety degrees with respect to sections 200, 100, 600, and 500, the connectors along the circle C (connectors 1110, 910, 1150, 950, 1210, 1010, 1180, and 980, (i.e. in the circular direction of rotation) were moved half a section side arc length.

In the third configuration of FIGS. 4A and 4B, along circular line C, connectors 980 and 1110 hold sections 100 and 700 together, connectors 910 and 1150 hold sections 200 and 300 together, connectors 950 and 1210 hold sections 500 and 400 together, and connectors 1010 and 1180 hold sections 600 and 800 together. The connectors along circular line C have thus changed where they are located with respect to sections that they connect and in some cases now connect different sections together. Other than the connectors along circular line C, the other connectors as shown in FIGS. 4A–4B, continue to join together the same sections that they joined together in FIGS. 1A–1B and those other connectors do not move with respect to the sections that they join together.

Figure 5A:
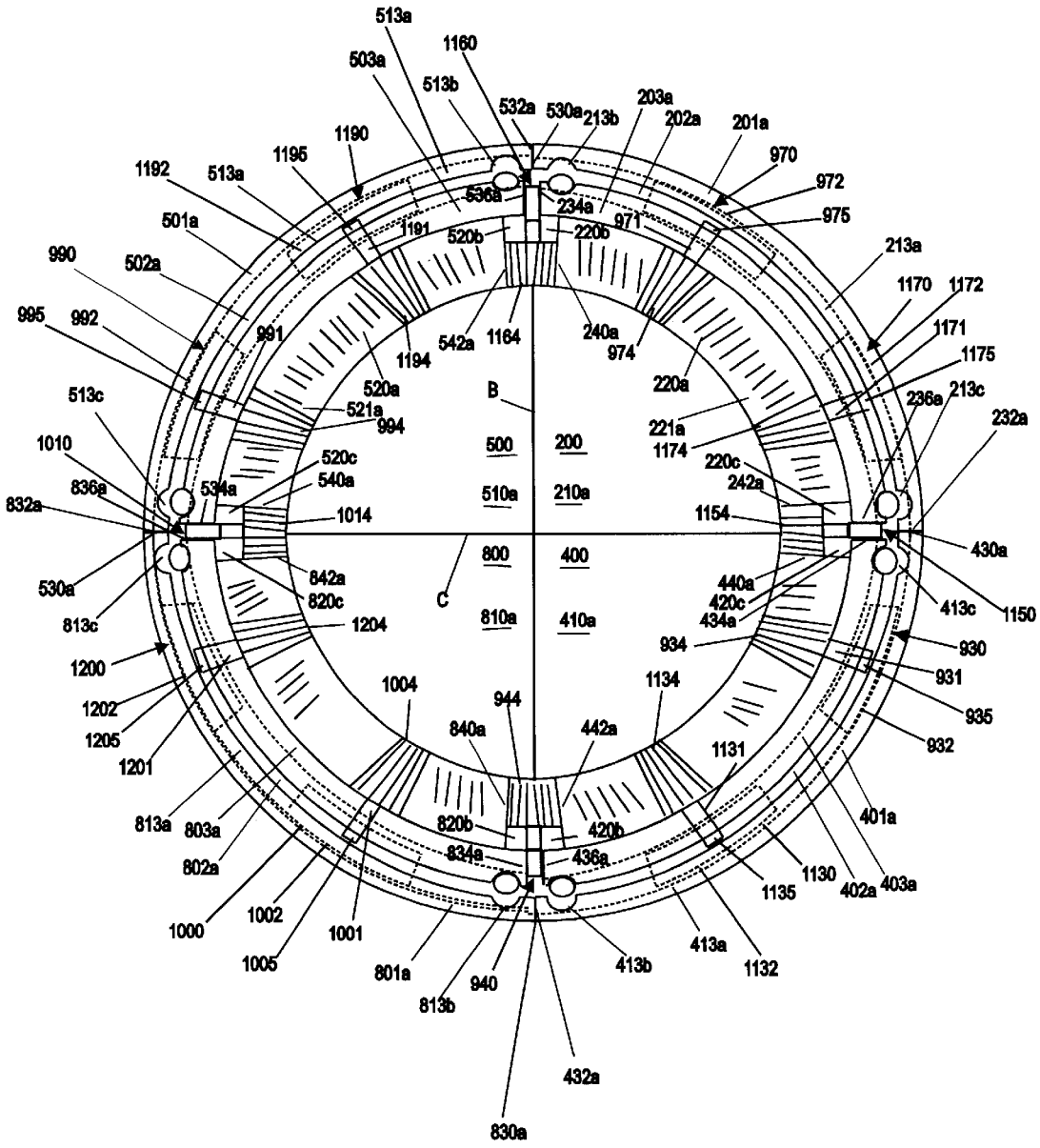
FIGS. 5A and 5B show interior sectional views of a first half and a second half of the first sphere in the first configuration of FIG. 1 separated along circle A.
Figure 5B:
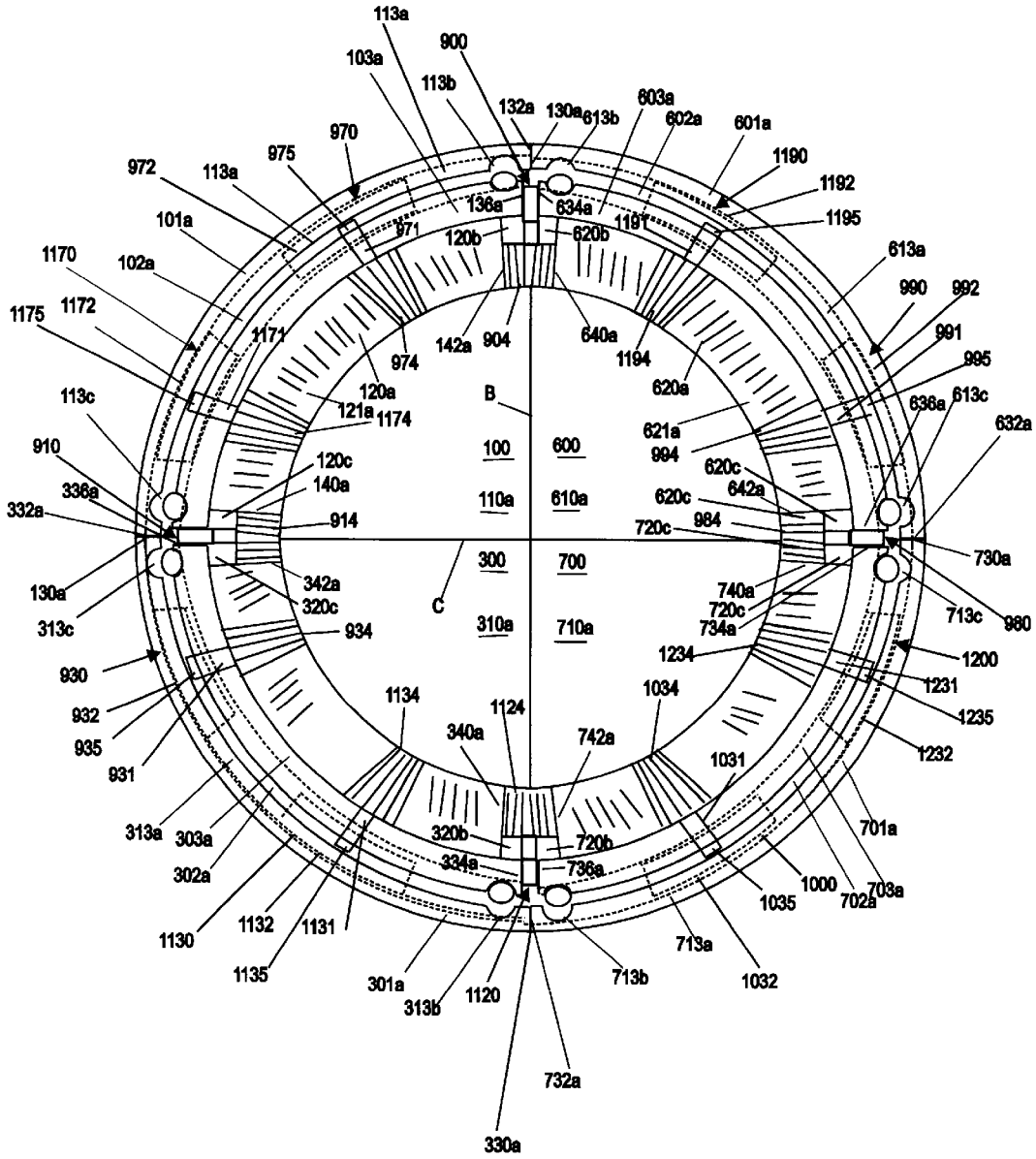

FIGS. 5A and 5B show interior sectional views of a first half and a second half of the first sphere 10 along with the location of gears in the first configuration of FIG. 1 separated along circle A.

Along circle A, FIG. 5A shows an interior view of sections 500, 200, 400, and 800. The sections 500, 200, 400, and 800 are comprised of surfaces 510*a*, 210*a*, 410*a*, and 810*a* respectively along the circle A shown in FIG. 1A. Section 500 is comprised of a solid portion 501*a*, a channel opening 502*a*, a solid portion 503*a*, rail channels 513*a*, 513*b*, and 513*c*, and gear channel 520*a*, 520*b*, and 520*c*. The solid portion 501*a* has a first end 530*a* and a second end 532*a*. The solid portion 503*a* has a first end 534*a* and a second end 536*a*. The gear channel 520*a* has a first end 540*a* and a second end 542*a*. There are a plurality of ridges 521*a* in the gear channel 520*a*. The rail channel 513*a* is shown in dashed lines in FIG. 5A and runs from the first end 530*a* to the second end 532*a* near the solid portion 501*a* and from the first end 540*a* to the second end 542*a* near the solid portion 503*a*.

The location of a curved rail 992 for the connector 990 is shown in dashed lines in FIG. 5A and in FIG. 1B. The curved rail 992 lies inside the section 500 in FIG. 1, and inside the channel 513*a*. The curved rail 992 is connected by a curved piece 995 to another curved rail 993 as shown in dashed lines in FIG. 1B. The curved piece 995 is connected to a shaft 991, shown in FIG. 5A and whose location is also shown by dashed lines in FIG. 1B. The shaft 991 is connected to a conical gear 994 which is partially shown in FIG. 5A and whose location is shown by dashed lines in FIG. 1B.

To insert the curved rail 992 into the rail channel 513*a*, the curved rail 992 is located parallel to the rail channel 513*a* and pushed through the rail opening 502*a*. The solid portions 501*a* and 503*a* preferably are elastic so that the rail opening 502*a* expands to allow the curved rail 992 to enter the rail channel 513*a* and then after the curved rail 992 is within the rail channel 513*a*, the rail opening 502*a* contracts to the size shown in FIG. 5A in order to retain the curved rail 992 within the rail channel 513*a* (or within one of the other rail channels, as will be described, after a rotation).

Along circle A, the sections 200, 400 and 800 in FIG. 5A have portions very similar to the section 500.

Sections 200, 400, and 800 are comprised of solid portions 201*a*, 401*a*, and 801*a*, respectively, channel openings 202*a*, 402*a*, and 802*a* respectively, solid portions 203*a*, 403*a*, and 803*a*, respectively, rail channels 213*a–c*, 413*a–c*, and 813*a–c* respectively, gear channels 220*a–c*, 420*a–c* and 820*a–c*, respectively. The solid portions 201*a*, 401*a*, and 801*a* have first ends 230*a*, 430*a*, and 830*a*, respectively, and second ends 232*a*, 432*a*, and 832*a*, respectively. The solid portions 203*a*, 403*a*, and 803*a* respectively have first ends 234*a*, 434*a*, 834*a* and second ends 236*a*, 436*a*, and 836*a* respectively. The gear channels 220*a*, 420*a*, and 820*a* have first ends 240*a*, 440*a*, and 840*a* respectively, and second ends 242*a*, 442*a*, and 842*a*, respectively. There are a plurality of ridges 221*a*, 421*a*, and 821*a* in the gear channels 220*a*, 420*a*, and 820*a* respectively. The rail channels 213*a*, 413*a*, and 813*a* are shown in dashed lines in FIG. 5A and run from the first ends 230*a*, 430*a*, and 830*a*, respectively to the second ends 232*a*, 432*a*, and 832*a*, respectively, near the solid portions 201*a*, 401*a*, 801*a*, respectively and from the first end 240*a*, 440*a*, and 840*a*, respectively to the second end 242*a*, 442*a*, and 842*a*, respectively near the solid portions 203*a*, 403*a*, and 803*a*, respectively.

The location of curved rails 1192, 972, 1172, 932, 1132, 1002, and 1202, respectively for the connectors 1190, 970, 1170, 930, 1130, 1000, and 1200, respectively, are shown in dashed lines in FIG. 5A and in FIGS. 1A and 1B. Curved rail 1192 lies inside section 500 and inside channel 513*a*. Curved rails 972 and 1172 lie inside section 200 and inside channel 213*a*. Curved rails 930 and 1130 lie inside section 400 and inside channel 413*a*. Curved rails 1002 and 1202 lie inside section 800 and inside channel 813*a*. The curved rails 1192, 972, 1172, 932, 1132, 1002, and 1202, respectively are connected by curved pieces 1195, 975, 1175, 935, 1135, 1005, and 1205, respectively to another curved rail 1193, 973, 1173, 933, 1133, 1003, and 1203 as shown in dashed lines in one or both of FIGS. 1A and 1B. The curved pieces 1195, 975, 1175, 935, 1135, 1005, and 1205 are connected to shafts 1191, 971, 1171, 931, 1131, 1001, and 1201, respectively, shown in FIG. 5A and whose locations are also shown by dashed lines in FIGS. 1A and 1B. The shafts 1191, 971, 1171, 931, 1131, 1001, and 1201 are connected to conical gears 1194, 974, 1174, 934, 1134, 1004, and 1204, respectively, which is partially shown in FIG. 5A and whose location is shown by dashed lines in one or both of FIGS. 1A and 1B.

Insertion of the curved rails 1192, 972, 1172, 932, 1132, 1002, and 1202 into the rail channels 513*a* (1192 goes into), 213*a* (972 and 1172 go into), 413*a* (932 and 1132 go into), and 813*a* (1002 and 1202 go into), is similar to that described for insertion of curved rail 992 into the rail channel 513*a*.

FIG. 5A also shows the connectors 1160, 1150, 940, and 1010. Only a perspective portion of these connectors are shown, since they are located with their centers down ¼ of a section side arc length away from the nearest pole. For example, the center of connector 1160 is ¼ of a section side arc length away from the "N" pole or North Pole.

FIG. 5B shows sections 100, 600, 700, and 300 when the sphere 10 of the configuration of FIGS. 1A and 1B is cut along circle A. The sections 100, 600, 700, and 300 in FIG. 5B have portions very similar to those for sections 500, 200, 400, and 800 of FIG. 5A.

Sections 100, 600, 700, and 300 are comprised of solid portions 101*a*, 601*a*, 701*a*, and 301*a*, respectively, channel openings 102*a*, 602*a*, 702*a*, and 302*a* respectively, solid portions 103*a*, 603*a*, 703*a*, and 303*a*, respectively, rail channels 113*a–c*, 613*a–c*, 713*a–c*, and 313*a–c* respectively, gear channels 120*a–c*, 620*a–c*, 720*a–c* and 320*a–c*, respectively. The solid portions 101*a*, 601*a*, 701*a*, and 301*a* have first ends 130*a*, 630*a*, 730*a*, and 330*a*, respectively, and second ends 132*a*, 632*a*, 732*a*, and 332*a*, respectively. The solid portions 103*a*, 603*a*, 703*a*, and 303*a* respectively have first ends 134*a*, 634*a*, 734*a*, 334*a* and second ends 136*a*, 636*a*, 736*a*, and 336*a* respectively. The gear channels 120*a*, 620*a*, 720*a*, and 320*a* have first ends 140*a*, 640*a*, 740*a*, and 340*a* respectively, and second ends 142*a*, 642*a*, 742*a*, and 342*a*, respectively. There are a plurality of ridges 121*a*, 621*a*, 721*a*, and 321*a* in the gear channels 120*a*, 620*a*, 720*a*, and 320*a* respectively. The rail channels 113*a*, 613*a*, 713*a*, and 313*a* are shown in dashed lines in FIG. 5A and run from the first ends 130*a*, 630*a*, 730*a*, and 330*a*, respectively to the second ends 132*a*, 632*a*, 732*a*, and 332*a*, respectively, near the solid portions 101*a*, 601*a*, 701*a*, 301*a*, respectively and from the first end 140*a*, 640*a*, 740*a*, and 340*a*, respectively to the second end 142*a*, 642*a*, 742*a*, and 342*a*, respectively near the solid portions 103*a*, 603*a*, 703*a*, and 303*a*, respectively.

The location of curved rails 1173, 973, 1193, 993, 1203, 1003, 1133, and 933, respectively for the connectors 1170, 970, 1190, 990, 1200, 1000, 1130, and 930, respectively, are shown in dashed lines in FIG. 5B and in one or both of FIGS. 1A and 1B. Curved rail 1173 and 973 lies inside section 100 and inside channel 113*a*. Curved rails 1193 and 993 lie inside section 600 and inside channel 613*a*. Curved rails 1203 and 1003 lie inside section 700 and inside channel 713*a*. Curved rails 1133 and 933 lie inside section 300 and inside channel 313*a*. The curved rails 1173, 973, 1193, 993, 1203, 1003, 1133, and 933, respectively are connected by curved pieces 1175, 975, 1195, 995, 1205, 1005, 1135, and 935, respectively, to another curved rail 1172, 972, 1192, 992, 1202, 1002, 1132, and 932, as shown in dashed lines in one or both of FIGS. 1A and 1B. The curved pieces 1175, 975, 1195, 995, 1205, 1005, 1135, and 935 are connected to shafts 1171, 971, 1191, 991, 1201, 1001, 1131, and 931, respectively, shown in FIG. 5B and whose locations are also shown by dashed lines in one or both of FIGS. 1A and 1B. The shafts 1171, 971, 1191, 991, 1201, 1001, 1131, and 931 are connected to conical gears 1174, 974, 1194, 994, 1204, 1004, 1134, and 934, respectively, which is partially shown in FIG. 5B and whose location is shown by dashed lines in one or both of FIGS. 1A and 1B.

Insertion of the curved rails 1173, 973, 1193, 993, 1203, 1003, 1133, and 933 into the rail channels 113*a* (1173 and 973 go into), 613*a* (1193 and 993 go into), 713*a* (1203 and 1003 go into), and 313*a* (1133 and 933 go into), is similar to that described for insertion of curved rail 992 into the rail channel 513*a*.

FIG. 5B also shows the connectors 900, 980, 1120, and 910. Only a perspective portion of these connectors are shown, since they are located with their centers down ¼ of a section side arc length away from the nearest pole.

Figure 6A:
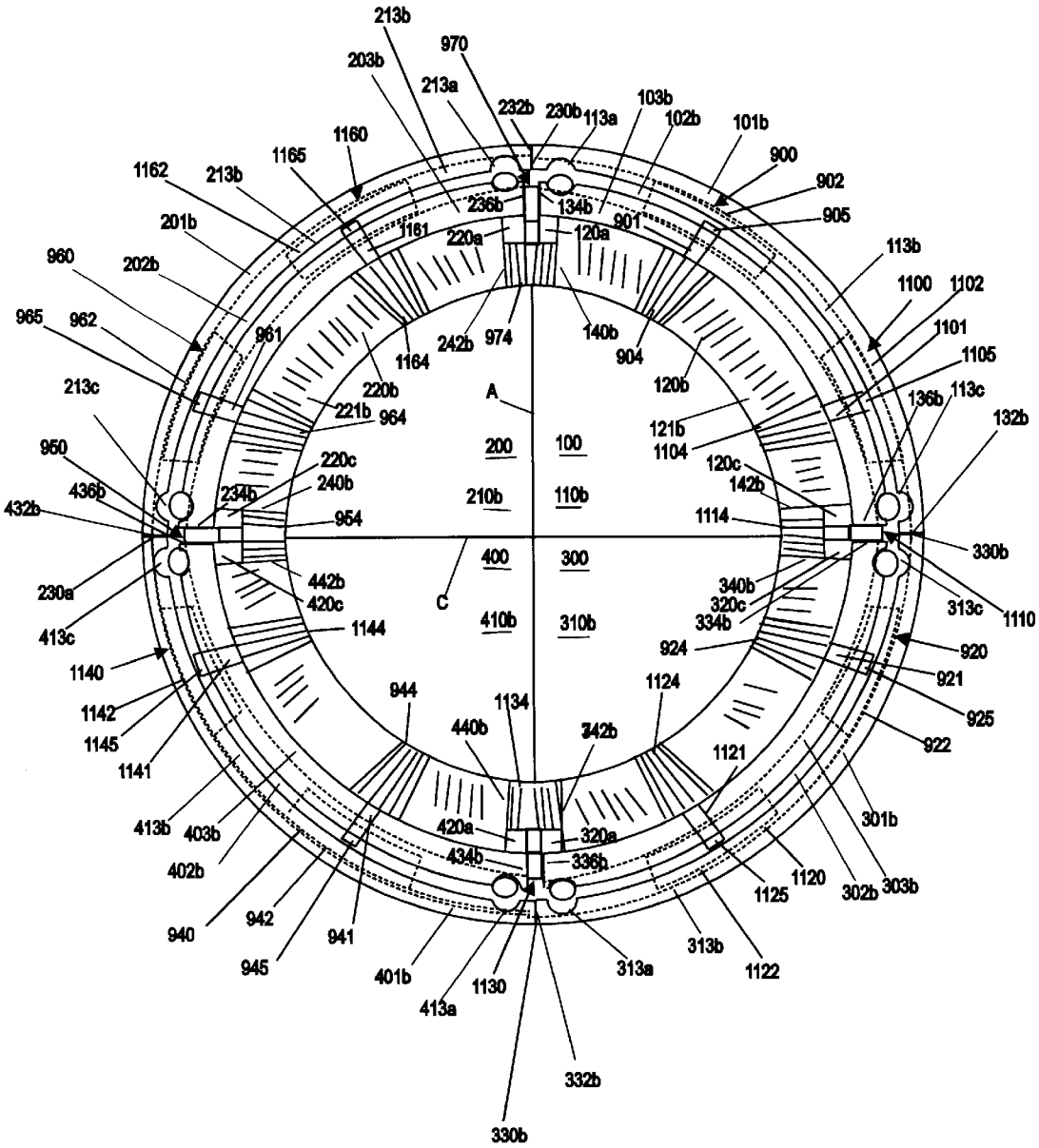
FIGS. 6A and 6B show interior sectional views of a first half and a second half of the first sphere in the first configuration of FIG. 1 separated along circle B.

FIG. 6A shows sections 200, 100, 300, and 400 when the sphere 10 of the configuration of FIGS. 1A and 1B is cut along circle B. The parts of sections 200, 100, 300, and 400 as shown in FIG. 6A have portions very similar to those for FIG. 5A.

Sections 200, 100, 300, and 400 are comprised of solid portions 201*b*, 101*b*, 301*b*, and 401*b*, respectively, channel openings 202*b*, 102*b*, 302*b*, and 402*b* respectively, solid portions 203*b*, 103*b*, 303*b*, and 403*b*, respectively, rail channels 213*a–c*, 113*a–c*, 313*a–c*, and 413*a–c*respectively, gear channels 220*a–c*, 120*a–c*, 320*a–c* and 420*a–c*, respectively. The solid portions 201*b*, 101*b*, 301*b*, and 401*b* have first ends 230*b*, 130*b*, 330*b*, and 430*b*, respectively, and second ends 232*b*, 132*b*, 332*b*, and 432*b*, respectively. The solid portions 203*b*, 103*b*, 303*b*, and 403*b* respectively have first ends 234*b*, 134*b*, 334*b*, 434*b* and second ends 236*b*, 136*b*, 336*b*, and 436*b* respectively. The gear channels 220*b*, 120*b*, 320*b*, and 420*b* have first ends 240*b*, 140*b*, 340*b*, and 440*b* respectively, and second ends 242*b*, 142*b*, 342*b*, and 442*b*, respectively. There are a plurality of ridges 221*b*, 121*b*, 321*b*, and 421*b* in the gear channels 220*b*, 120*b*, 320*b*, and 420*b*, respectively. The rail channels 213*b*, 113*b*, 313*b*, and 413*b* are shown in dashed lines in FIG. 6A and run from the first ends 230*b*, 130*b*, 330*b*, and 430*b*, respectively to the second ends 232*b*, 132*b*, 332*b*, and 432*b*, respectively, near the solid portions 201*b*, 101*b*, 301*b*, 401*b*, respectively and from the first end 240*b*, 140*b*, 340*b*, and 440*b*, respectively to the second end 242*b*, 142*b*, 342*b*, and 442*b*, respectively near the solid portions 203*b*,103*b*, 303*b*, and 403*b*, respectively.

The location of curved rails 962, 1162, 902, 1102, 922, 1122, 942, and 1142, respectively for the connectors 960, 1160, 900, 1100, 920, 1120, 940, and 1140, respectively, are shown in dashed lines in FIG. 5B and in one or both of FIGS. 1A and 1B. Curved rails 962 and 1162 lie inside section 200 and inside channel 213*b*. Curved rails 902 and 1102 lie inside section 100 and inside channel 113*b*. Curved rails 922 and 1122 lie inside section 300 and inside channel 313*b*. Curved rails 942 and 1142 lie inside section 400 and inside channel 413*b*. The curved rails 962, 1162, 902, 1102, 922, 1122, 942, and 1142, respectively are connected by curved pieces 965, 1165, 905, 1105, 925, 1125, 945, and 1145, respectively, to another curved rail 963, 1163, 903, 1103, 923, 1123, 943, and 1143, as shown in dashed lines in one or both of FIGS. 1A and 1B. The curved pieces 965, 1165, 905, 1105, 925, 1125, 945, and 1145 are connected to shafts 961, 1161, 901, 1101, 921, 1121, 941, and 1141, respectively, shown in FIG. 6A and whose locations are also shown by dashed lines in one or both of FIGS. 1A and 1B. The shafts 961, 1161, 901, 1101, 921, 1121, 941, and 1141 are connected to conical gears 964, 1164, 904, 1104, 924, 1124, 944, and 1144, respectively, which is partially shown in FIG. 6B and whose location is shown by dashed lines in one or both of FIGS. 1A and 1B.

Insertion of the curved rails 962, 1162, 902, 1102, 922, 1122, 942, and 1142 into the rail channels 213*b* (962 and 1162 go into), 113*b* (902 and 1102 go into), 313*b* (922 and 1122 go into), and 413*b* (942 and 1142 go into), is similar to that described for insertion of curved rail 992 into the rail channel 513*a*.

FIG. 6A also shows the connectors 970, 1110, 1130, and 950. Only a perspective portion of these connectors are shown, since they are located with their centers down ¼ of a section side arc length away from the nearest pole.

Figure 6B:
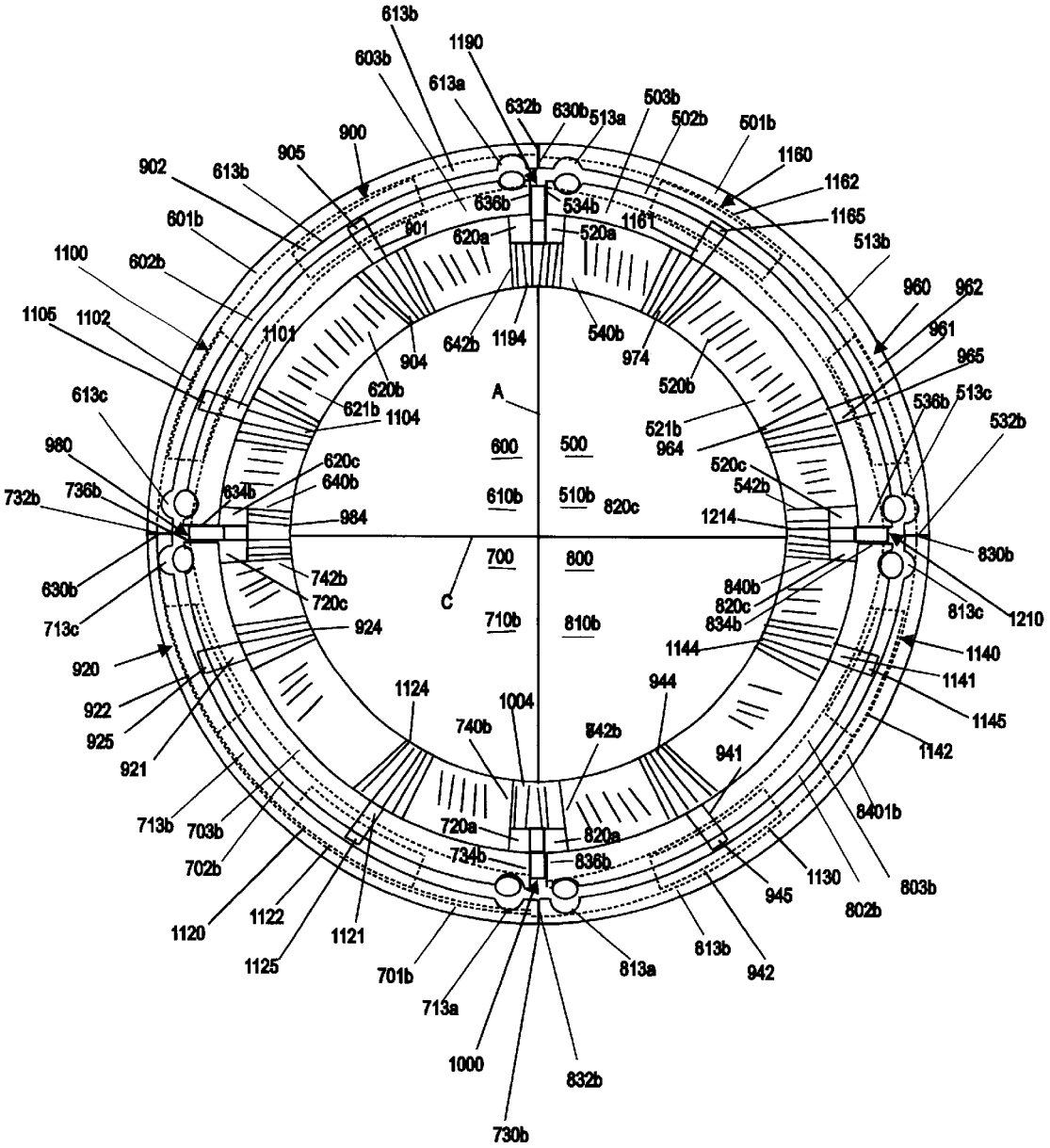

FIG. 6B shows sections 600, 500, 800, and 700 when the sphere 10 of the configuration of FIGS. 1A and 1B is cut along circle B. The parts of sections 600, 500, 800, and 700 as shown in FIG. 6B have portions very similar to those for FIG. 5A.

Sections 600, 500, 800, and 700 are comprised of solid portions 601*b*, 501*b*, 801*b*, and 701*b*, respectively, channel openings 602*b*, 502*b*, 802*b*, and 702*b* respectively, solid portions 603*b*, 503*b*, 803*b*, and 703*b*, respectively, rail channels 613*a–c*, 513*a–c*, 813*a–c*, and 713*a–c* respectively, gear channels 620*a–c*, 520*a–c*, 820*a–c* and 720*a–c*, respectively. The solid portions 601*b*, 501*b*, 801*b*, and 701*b* have first ends 630*b*, 530*b*, 830*b*, and 730*b*, respectively, and second ends 632*b*, 532*b*, 832*b*, and 732*b*, respectively. The solid portions 603*b*, 503*b*, 803*b*, and 703*b* respectively have first ends 634*b*, 534*b*, 834*b*, 734*b* and second ends 636*b*, 536*b*, 836*b*, and 736*b* respectively. The gear channels 620*b*, 520*b*, 820*b*, and 720*b* have first ends 640*b*, 540*b*, 840*b*, and 740*b* respectively, and second ends 642*b*, 542*b*, 842*b*, and 742*b*, respectively. There are a plurality of ridges 621*b*, 521*b*, 821*b*, and 721*b* in the gear channels 620*b*, 520*b*, 820*b*, and 720*b*, respectively. The rail channels 613*b*, 513*b*, 813*b*, and 713*b* are shown in dashed lines in FIG. 6B and run from the first ends 630*b*, 530*b*, 830*b*, and 730*b*, respectively to the second ends 632*b*, 532*b*, 832*b*, and 732*b*, respectively, near the solid portions 601*b*, 501*b*, 801*b*, 701*b*, respectively and from the first end 640*b*, 540*b*, 840*b*, and 740*b*, respectively to the second end 642*b*, 542*b*, 842*b*, and 742*b*, respectively near the solid portions 603*b*, 503*b*, 803*b*, and 703*b*, respectively.

The location of curved rails 1103, 903, 1163, 963, 1143, 943, 1123, and 923, respectively for the connectors 1100, 900, 1160, 960, 1140, 940, 1120, and 920, respectively, are shown in dashed lines in FIG. 6B and in one or both of FIGS. 1A and 1B. Curved rails 1103 and 903 lie inside section 600 and inside channel 613*b*. Curved rails 1163 and 963 lie inside section 500 and inside channel 513*b*. Curved rails 1143 and 943 lie inside section 800 and inside channel 813*b*. Curved rails 1123 and 923 lie inside section 700 and inside channel 713*b*. The curved rails 1103, 903, 1163, 963, 1143, 943, 1123, and 923, respectively are connected by curved pieces 1105, 905, 1165, 965, 1145, 945, 1125, and 925, respectively, to another curved rail 1102, 902, 1162, 962, 1142, 942, 1122, and 922, as shown in dashed lines in one or both of FIGS. 1A and 1B. The curved pieces 1105, 905, 1165, 965, 1145, 945, 1125, and 925 are connected to shafts 1101, 901, 1161, 961, 1141, 941, 1121, and 921, respectively, shown in FIG. 6B and whose locations are also shown by dashed lines in one or both of FIGS. 1A and 1B. The shafts 1101, 901, 1161, 961, 1141, 941, 1121, and 921 are connected to conical gears 1104, 904, 1164, 964, 1144, 944, 1124, and 924, respectively, which is partially shown in FIG. 6B and whose location is shown by dashed lines in one or both of FIGS. 1A and 1B.

Insertion of the curved rails 1103, 903, 1163, 963, 1143, 943, 1123, and 923, into the rail channels 613*b* (1103 and 903 go into), 513*b* (1163 and 963 go into), 813*b* (1143 and 943 go into), and 713*b* (1123 and 923 go into), is similar to that described for insertion of curved rail 992 into the rail channel 513*a*.

FIG. 6B also shows the connectors 1190, 1210, 1000, and 980. Only a perspective portion of these connectors are shown, since they are located with their centers down ¼ of a section side arc length away from the nearest pole.

Figure 7A:
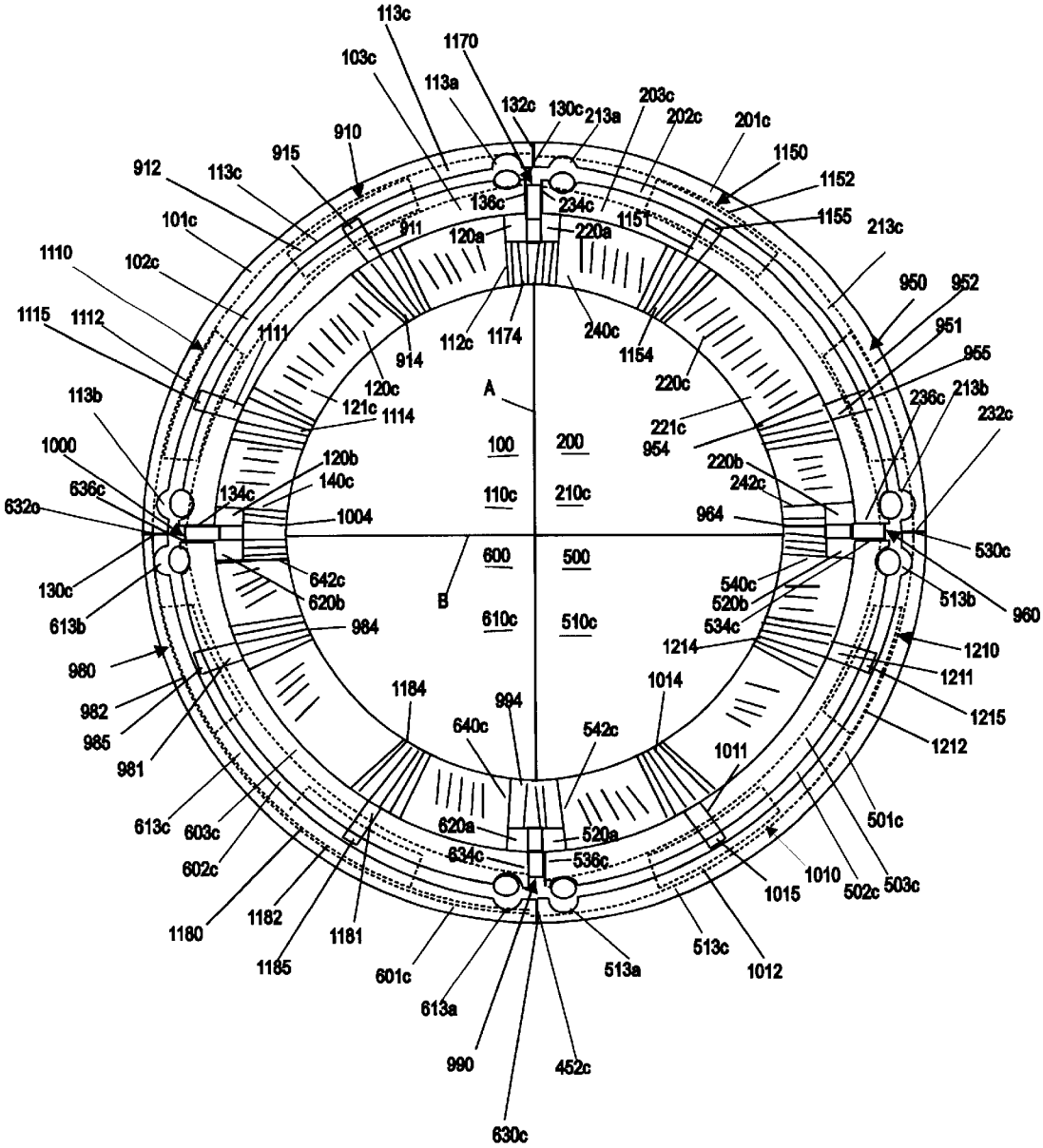
FIGS. 7A and 7B show interior sectional views of a first half and a second half of the first sphere in the first configuration of FIG. 1 separated along circle C.

FIG. 7A shows sections 100, 200, 500, and 600 when the sphere 10 of the configuration of FIGS. 1A and 1B is cut along circle C. The parts of sections 100, 200, 500, and 600 as shown in FIG. 7A have portions very similar to those for FIG. 5A.

Sections 100, 200, 500, and 600 are comprised of solid portions 101*c*, 201*c*, 501*c*, and 601*c*, respectively, channel openings 102*c*, 202*c*, 502*c*, and 602*c* respectively, solid portions 103*c*, 203*c*, 503*c*, and 603*c*, respectively, rail channels 113*a–c*, 213*a–c*, 513*a–c*, and 613*a–c* respectively, gear channels 120*a–c*, 220*a–c*, 520*a–c* and 620*a–c*, respectively. The solid portions 101*c*, 201*c*, 501*c*, and 601*c* have first ends 130*c*, 230*c*, 530*c*, and 630*c*, respectively, and second ends 132*c*, 232*c*, 532*c*, and 632*c*, respectively. The solid portions 103*c*, 203*c*, 503*c*, and 603*c* respectively have first ends 134*c*, 234*c*, 534*c*, 634*c* and second ends 136*c*, 236*c*, 536*c*, and 636*c* respectively. The gear channels 120*c*, 220*c*, 520*c*, and 620*c* have first ends 140*c*, 240*c*, 540*c*, and 640*c* respectively, and second ends 142*c*, 242*c*, 542*c*, and 642*c*, respectively. There are a plurality of ridges 121*c*, 221*c*, 521*c*, and 621*c* in the gear channels 120*c*, 220*c*, 520*c*, and 620*c*, respectively. The rail channels 113*c*, 213*c*, 513*c*, and 613*c* are shown in dashed lines in FIG. 7A and run from the first ends 130*c*, 230*c*, 530*c*, and 630*c*, respectively to the second ends 132*c*, 232*c*, 532*c*, and 632*c*, respectively, near the solid portions 101*c*, 201*c*, 501*c*, 601*c*, respectively and from the first end 140*c*, 240*c*, 540*c*, and 640*c*, respectively to the second end 142*c*, 242*c*, 542*c*, and 642*c*, respectively near the solid portions 103*c*, 203*c*, 503*c*, and 603*c*, respectively.

The location of curved rails 1112, 912, 1152, 952, 1212, 1012, 1182, and 982, respectively for the connectors 1110, 910, 1150, 950, 1210, 1010, 1180, and 980, respectively, are shown in dashed lines in FIG. 7A and in one or both of FIGS. 1A and 1B. Curved rails 1112 and 912 lie inside section 100 and inside channel 113*c*. Curved rails 1152 and 952 lie inside section 200 and inside channel 213*c*. Curved rails 1212 and 1012 lie inside section 500 and inside channel 513*c*. Curved rails 1182 and 982 lie inside section 600 and inside channel 613*c*. The curved rails 1112, 912, 1152, 952, 1212, 1012, 1182, and 982, respectively, are connected by curved pieces 1115, 915, 1155, 955, 1215, 1015, 1185, and 985, respectively, to another curved rail 1113, 913, 1153, 953, 1213, 1013, 1183, and 983, as shown in dashed lines in one or both of FIGS. 1A and 1B. The curved pieces 1115, 915, 1155, 955, 1215, 1015, 1185, and 985 are connected to shafts 1111, 911, 1151, 951, 1211, 1011, 1181, and 981, respectively, shown in FIG. 7A and whose locations are also shown by dashed lines in one or both of FIGS. 1A and 1B. The shafts 1111, 911, 1151, 951, 1211, 1011, 1181, and 981 are connected to conical gears 1114, 914, 1154, 954, 1214, 1014, 1184, and 984, respectively, which is partially shown in FIG. 7A and whose location is shown by dashed lines in one or both of FIGS. 1A and 1B.

Insertion of the curved rails 1112, 912, 1152, 952, 1212, 1012, 1182, and 982 into the rail channels 113*c* (1112 and 912 go into), 213*c* (1152 and 952 go into), 513*c* (1212 and 1012 go into), and 613*c* (1182 and 982 go into), is similar to that described for insertion of curved rail 992 into the rail channel 513*a*.

FIG. 7A also shows the connectors 1170, 960, 990, and 1000. Only a perspective portion of these connectors are shown, since they are located with their centers down ¼ of a section side arc length away from the nearest pole.

Figure 7B:
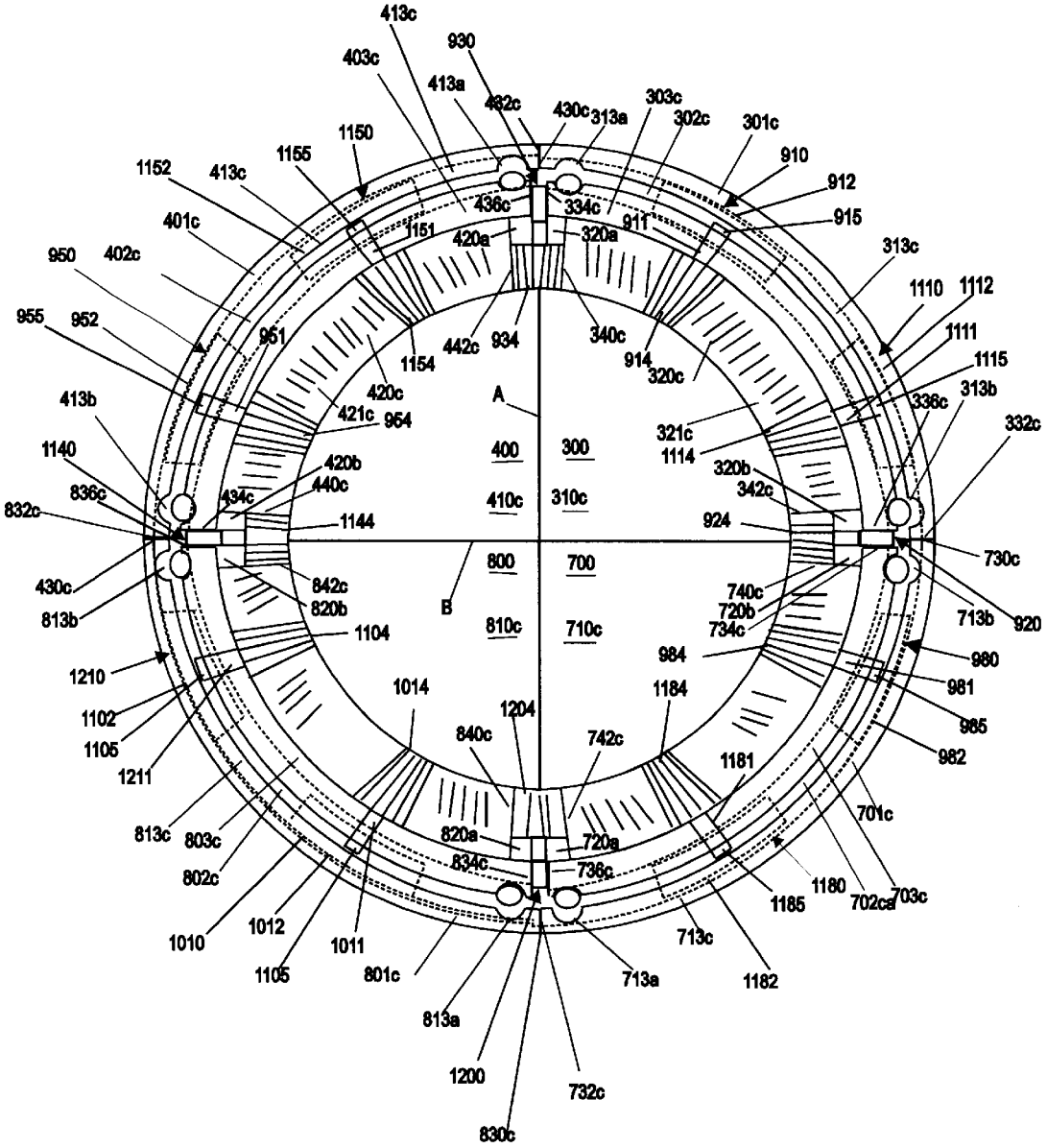

FIG. 7B shows sections 400, 300, 700, and 800 when the sphere 10 of the configuration of FIGS. 1A and 1B is cut along the circle C. The parts of sections 400, 300, 700, and 800 as shown in FIG. 7B have portions very similar to those for FIG. 5A.

Sections 400, 300, 700, and 800 are comprised of solid portions 401*c*, 301*c*, 701*c*, and 801*c*, respectively, channel openings 402*c*, 302*c*, 702*c*, and 802*c* respectively, solid portions 403*c*, 303*c*, 703*c*, and 803*c*, respectively, rail channels 413*a–c*, 313*a–c*, 713*a–c*, and 813*a–c* respectively, gear channels 420*a–c*, 320*a–c*, 720*a–c* and 820*a–c*, respectively. The solid portions 401*c*, 301*c*, 701*c*, and 801*c* have first ends 430*c*, 330*c*, 730*c*, and 830*c*, respectively, and second ends 432*c*, 332*c*, 732*c*, and 832*c*, respectively. The solid portions 403*c*, 303*c*, 703*c*, and 803*c* respectively have first ends 434*c*, 334*c*, 734*c*, 834*c* and second ends 436*c*, 336*c*, 736*c*, and 836*c* respectively. The gear channels 420*c*, 320*c*, 720*c*, and 820*c* have first ends 440*c*, 340*c*, 740*c*, and 840*c* respectively, and second ends 442*c*, 342*c*, 742*c*, and 842*c*, respectively. There are a plurality of ridges 421*c*, 321*c*, 721*c*, and 821*c* in the gear channels 420*c*, 320*c*, 720*c*, and 820*c*, respectively. The rail channels 413*c*, 313*c*, 713*c*, and 813*c* are shown in dashed lines in FIG. 7B and run from the first ends 430*c*, 330*c*, 730*c*, and 830*c*, respectively to the second ends 432*c*, 332*c*, 732*c*, and 832*c*, respectively, near the solid portions 401*c*, 301*c*, 701*c*, 801*c*, respectively and from the first end 440*c*, 340*c*, 740*c*, and 840*c*, respectively to the second end 442*c*, 342*c*, 742*c*, and 842*c*, respectively near the solid portions 403*c*, 303*c*, 703*c*, and 803*c*, respectively.

The location of curved rails 953, 1153, 913, 1113, 983, 1183, 1013, and 1213, respectively for the connectors 950, 1150, 910, 1110, 980, 1180, 1010, and 1210, respectively, are shown in dashed lines in FIG. 7B and in one or both of FIGS. 1A and 1B. Curved rails 953 and 1153 lie inside section 400 and inside channel 413*c*. Curved rails 913 and 1113 lie inside section 300 and inside channel 313*c*. Curved rails 983 and 1183 lie inside section 700 and inside channel 713*c*. Curved rails 1013 and 1213 lie inside section 800 and inside channel 813*c*. The curved rails 953, 1153, 913, 1113, 983, 1183, 1013, and 1213, respectively, are connected by curved pieces 955, 1155, 915, 1115, 985, 1185, 1015, and 1215, respectively, to another curved rail 952, 1152, 912, 1112, 982, 1182, 1012, and 1212 as shown in dashed lines in one or both of FIGS. 1A and 1B. The curved pieces 955, 1155, 915, 1115, 985, 1185, 1015, and 1215 are connected to shafts 951, 1151, 911, 1111, 981, 1181, 1011, and 1211, respectively, shown in FIG. 7B and whose locations are also shown by dashed lines in one or both of FIGS. 1A and 1B. The shafts 951, 1151, 911, 1111, 981, 1181, 1011, and 1211 are connected to conical gears 954, 1154, 914, 1114, 984, 1184, 1014, and 1214 respectively, which is partially shown in FIG. 7B and whose location is shown by dashed lines in one or both of FIGS. 1A and 1B.

Insertion of the curved rails 953, 1153, 913, 1113, 983, 1183, 1013, and 1213 into the rail channels 413*c* (953 and 1153 go into), 313*c* (913 and 1113 go into), 713*c* (983 and 1183 go into), and 813*c* (1013 and 1213 go into), is similar to that described for insertion of curved rail 992 into the rail channel 513*a*.

FIG. 7B also shows the connectors 930, 920, 1200, and 1140. Only a perspective portion of these connectors are shown, since they are located with their centers down ¼ of a section side arc length away from the nearest pole.

Figure 8:
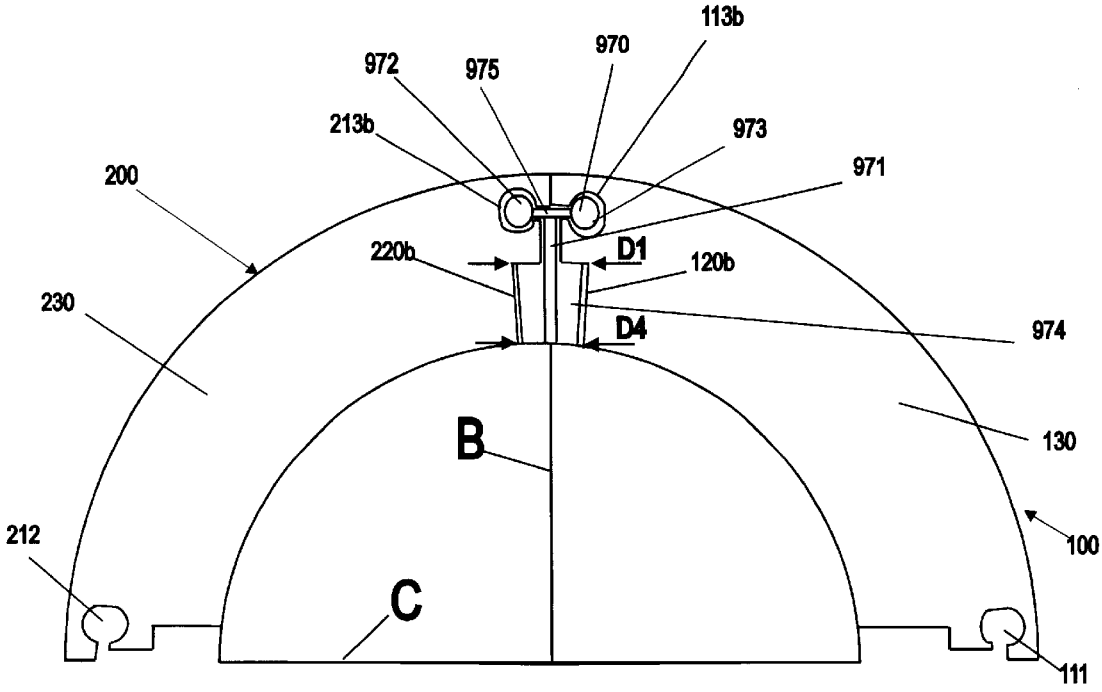
FIG. 8 shows an interior cross sectional view of two pieces of the first sphere joined together.

Each combination channel that a connector moves through, such as for example the combination channel comprised of channels 220*b* and 120*b* shown at the top of FIG. 6A, has a first width D1 which narrows to a smaller width D4 as shown in FIG. 8. FIG. 8 is a cross sectional view of sections 100 and 200 and the connector 970 along line D in FIG. 4A. The conical gears, such as conical gear 974 shown in FIG. 8, fit snugly in this gap so that each conical gear interacts with the ridges on both sides of the combination channel that it moves in. For example, conical gear 974 shown in FIG. 8, interacts with the ridges on both channel 220*b* and channel 120*b*. This interaction causes the gear 974 to rotate. When one section is moved with respect to an adjacent section, the gears of the connectors connecting the sections rotate and the curved rails, such as curved rails 972 and 973 in FIG. 8, slide in the rail channels, such as rail channels 213*b* and 113*b* respectively.

Similarly, in FIG. 5A, for example, gear 1164 interacts with ridges of channels 520*b* and 220*b*; gear 1154 interacts with ridges of channels 220*c* and 420*c*; gear 944 interacts with ridges of channels 420*b* and 820*b*; and gear 1014 interacts with ridges of channels 520*c* and 820*c*. In FIG. 5B, for example, gear 904 interacts with ridges of channels 120*b* and 620*b*; gear 984 interacts with ridges of channels 620*c* and 720*c*; gear 1124 interacts with ridges of channels 720*b* and 320*b*; and gear 914 interacts with ridges of channels 120*c* and 320*c*. In FIG. 6A, for example, gear 974 interacts with ridges of channels 220*b* and 120*b*; gear 1114 interacts with ridges of channels 120*c* and 320*c*; gear 1134 interacts with ridges of channels 420*b* and 320*b*; and gear 954 interacts with ridges of channels 220*c* and 420*c*. In FIG. 6B, for example, gear 1194 interacts with ridges of channels 620*b* and 520*b*; gear 1214 interacts with ridges of channels 520*c* and 820*c*; gear 1004 interacts with ridges of channels 720*b* and 820*b*; and gear 984 interacts with ridges of channels 620*c* and 720*c*. In FIG. 7A, for example, gear 1174 interacts with ridges of channels 120*a* and 220*a*; gear 964 interacts with ridges of channels 220*b* and 520*b*; gear 994 interacts with ridges of channels 620*b* and 520*b*; and gear 1004 interacts with ridges of channels 120*c* and 620*c*. In FIG. 7B, for example, gear 934 interacts with ridges of channels 420*a* and 320*a*; gear 924 interacts with ridges of channels 320*b* and 720*b*; gear 1204 interacts with ridges of channels 820*b* and 720*b*; and gear 1144 interacts with ridges of channels 420*c* and 820*c*.

Figure 9:
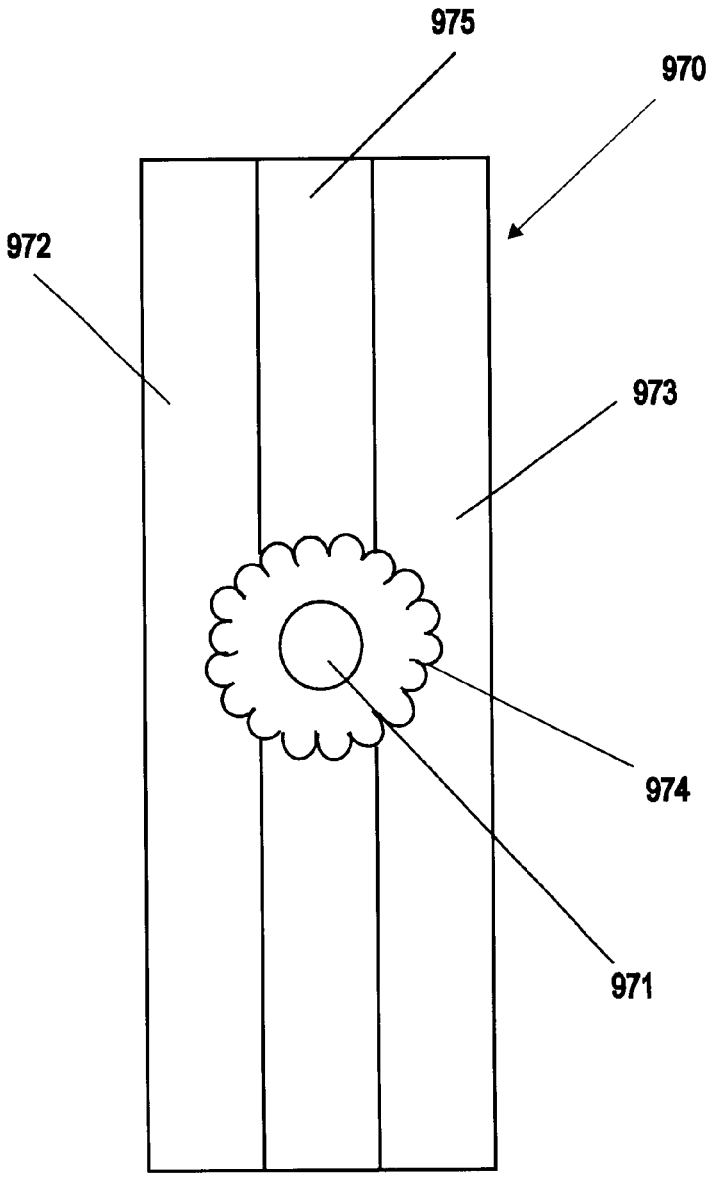
FIG. 9 shows a bottom planar view of a connector for connecting two or more pieces of the sphere.

FIG. 9 shows a bottom planar view of the connector 970 for connecting two sections 100 and 200 in the FIG. 1A configuration of the sphere 10. FIG. 9 shows a bottom view of curved rails 972 and 973, a bottom view of shaft 971, a bottom view of conical gear 974, and a bottom view of curved piece 975.

The surface of a section, such as a section 100, although shown with a certain shape in the drawings, may vary in shape, as well as in color.

I claim:

1. An apparatus comprising a plurality of sections comprised of a first section and a second section, the plurality of sections together forming a connected object;

a first connector which joins the first section to the second section;

wherein the first connector allows the first section to move with respect to the second section; and wherein the first connector is comprised of
first and second curved rails;
and a first gear;

wherein the first gear is connected to the first and second curved rails.

2. The apparatus of claim 1 wherein the first section is comprised of a rail channel and a gear channel;

the second section is comprised of a rail channel and a gear channel;

wherein the first and second curved rails each fit into both the rail channel of the first section and the rail channel of the second section;

and the gear of the first connector fits into a first combination channel comprised of the gear channel of the first section and the gear channel of the second section.

3. The apparatus of claim 2 wherein the first and second curved rails are connected to a first shaft; and the first gear is a conical gear which can rotate about the first shaft.

4. The apparatus of claim 3 wherein the gear channel of the first section includes ridges which interact with the first gear when the first section is moved with respect to the second section; and the gear channel of the second section includes ridges which interact with the first gear when the first section is moved with respect to the second section.

5. The apparatus of claim 2 wherein the first section has a top surface and the second section has a top surface;

and wherein the rail channel and gear channel of each the first and second section lie beneath the top surface of the corresponding section and within the sphere when the plurality of sections are put together to form the connected object.

6. The apparatus of claim 1 wherein the first and second curved rails are connected to a first shaft; and the first gear is a conical gear which can rotate about the first shaft.

7. An apparatus comprising a plurality of sections comprised of a first section and a second section, the plurality of sections together forming a connected object;

a first connector which joins the first section to the second section;

wherein the first connector allows the first section to move with respect to the second section;

wherein the plurality of sections is further comprised of third, fourth, fifth, sixth, seventh, and eighth sections;

further comprising a plurality of connectors which is comprised of the first connector and second, third, fourth, fifth, sixth, seventh, eighth, ninth, tenth, eleventh, twelfth, thirteenth, fourteenth, fifteenth, sixteenth, seventeenth, eighteenth, nineteenth, twentieth, twenty-first, twenty-second, twenty-third, and twenty-fourth connectors;

wherein in a first configuration of the connected object:

the first and second connectors join the first section to the sixth section;

the third and fourth connectors join the first section to the third section;

the fifth and sixth connectors join the third section to the seventh section;

the seventh and eighth connectors join the third section to the fourth section;

the ninth and tenth connectors join the fourth section to the eighth section;

the eleventh and twelfth connectors join the second section to the fourth section;

the thirteenth and fourteenth connectors joins the second section to the fifth section;

the fifteenth and sixteenth connectors joins the first section to the second section;

the seventeenth and eighteenth connectors join the sixth section to the seventh section;

the nineteenth and twentieth connectors join the fifth section to the sixth section;

the twenty-first and twenty-second connector join the seventh section to the eighth section; and the twenty-third and twenty-fourth connectors join the fifth section to the eighth section; wherein each of the plurality of connectors is comprised of first and second curved rails;

and a first gear;

wherein the first gear is connected to the first and second curved rails.

8. The apparatus of claim 7 wherein each of the plurality of sections is comprised of a rail channel and a gear channel;

wherein the first curved rail of each of the plurality of connectors fits into the rail channel of each of the plurality of sections;

and the second curved rail of each of the plurality of connectors fits into the rail channel of each of the plurality of sections;

and the gear of each of the plurality of connectors fits into a combination channel comprised of a gear channel of one section and a gear channel of an adjacent section.

9. The apparatus of claim 8 wherein the gear channel of each of the plurality of sections includes ridges which interact with the first gear of one of the plurality of connectors when each of the plurality of sections is moved with respect to another adjacent section of the plurality of sections.

10. The apparatus of claim 8 wherein each of the plurality of sections has a top surface;

and wherein the rail channel and gear channel of each of the plurality of sections lie beneath the top surface of the corresponding section and within the connected object when the plurality of sections are put together to form the connected object.

11. The apparatus of claim 8 wherein each of the plurality of sections is comprised of a number of rail channels equal to the number of sections each section is connected to and a number of gear channels equal to the number of sections each section is connected to;

wherein the first curved rail of each of the plurality of connectors fits into a rail channel of each of the plurality of sections;

and the second curved rail of each of the plurality of connectors fits into a rail channel of each of the plurality of sections;

and the gear of each of the plurality of connectors fits into a combination channel comprised of a gear channel of one section and a gear channel of an adjacent section.

12. The apparatus of claim 7 wherein the first and second curved rails of each the plurality of connectors are connected to a first shaft of each of the plurality of connectors; and the first gear of each of the plurality of connectors is a conical gear which can rotate about the first shaft of each of the plurality of connectors.

13. An apparatus comprising a plurality of sections comprised of a first section and a second section, the plurality of sections together forming a connected object;

a first connector which joins the first section to the second section;

wherein the first connector allows the first section to move with respect to the second section;

wherein the plurality of sections is further comprised of third, fourth, fifth, sixth, seventh, and eighth sections;

further comprising a plurality of connectors which is comprised of the first connector and second, third, fourth, fifth, sixth, seventh, eighth, ninth, tenth, eleventh, twelfth, thirteenth, fourteenth, fifteenth, sixteenth, seventeenth, eighteenth, nineteenth, twentieth, twenty-first, twenty-second, twenty-third, and twenty-fourth connectors;

wherein in a first configuration of the connected object:

the first and second connectors join the first section to the sixth section;

the third and fourth connectors join the first section to the third section;

the fifth and sixth connectors join the third section to the seventh section;

the seventh and eighth connectors join the third section to the fourth section;

the ninth and tenth connectors join the fourth section to the eighth section;

the eleventh and twelfth connectors join the second section to the fourth section;

the thirteenth and fourteenth connectors joins the second section to the fifth section;

the fifteenth and sixteenth connectors joins the first section to the second section;

the seventeenth and eighteenth connectors join the sixth section to the seventh section;

the nineteenth and twentieth connectors join the fifth section to the sixth section;

the twenty-first and twenty-second connector join the seventh section to the eighth section; and the twenty-third and twenty-fourth connectors join the fifth section to the eighth section;

further wherein a first half of the connected object comprised of the seventh, sixth, first and third sections can be rotated about a circular line A with respect to the other half of the connected object comprised of the fifth, second, fourth, and eighth sections to change the sphere from the first configuration to a second configuration where each of the plurality of connectors connects the sections as previously mentioned except in the second configuration:

the seventh connector and the sixteenth connector join the first and fourth sections;

the eighth connector and the twenty-first connector join the eighth and the third sections;

the fifteenth connector and the twentieth connector join the second and the sixth sections; and the nineteenth connector and the twenty-second connector join the fifth and seventh sections.

14. The apparatus of claim 13 further comprising wherein a first half of the connected object comprised of the first, second, fourth and third sections can be rotated about a circular line B with respect to the other half of the connected object comprised of the fifth, eighth, seventh, and sixth sections to change the connected object from the first configuration to a third configuration where each of the plurality of connectors connects the sections as previously mentioned in the first configuration except in the third configuration:

the first connector and the fourteenth connector join the fifth and the first sections;

the second connector and the fifth connector join the third and sixth sections;

the sixth connector and the ninth connector join the fourth and the seventh sections; and the thirteenth connector and the tenth connector join the second and the eighth sections.

15. The apparatus of claim 13 further comprising wherein a first half of the connected object comprised of the third, fourth, seventh, and eight sections can be rotated about a circular line C with respect to the other half of the connected object comprised of the first, second, fifth, and sixth sections to change the sphere from the first configuration to a second configuration where each of the plurality of connectors connects the sections as previously mentioned in the first configuration except in the third configuration:

the fourth connector and the seventeenth connector join the first section and the seventh section;

the eleventh section and the twenty-fourth section join the fifth section and the fourth section;

the twelfth connector and the third connector join the second section with the third section; and the twenty-third section and the eighteenth connector join the sixth section with the eighth section.

16. An apparatus comprising a plurality of sections comprised of a first section and a second section, the plurality of sections together forming a connected object;

a first connector which joins the first section to the second section;

wherein the first connector allows the first section to move with respect to the second section;

wherein the plurality of sections is further comprised of third, fourth, fifth, sixth, seventh, and eighth sections;

further comprising a plurality of connectors which is comprised of the first connector and second, third, fourth, fifth, sixth, seventh, eighth, ninth, tenth, eleventh, twelfth, thirteenth, fourteenth, fifteenth, sixteenth, seventeenth, eighteenth, nineteenth, twentieth, twenty-first, twenty-second, twenty-third, and twenty-fourth connectors;

wherein in a first configuration of the connected object:

the first and second connectors join the first section to the sixth section;

the third and fourth connectors join the first section to the third section;

the fifth and sixth connectors join the third section to the seventh section;

the seventh and eighth connectors join the third section to the fourth section;

the ninth and tenth connectors join the fourth section to the eighth section;

the eleventh and twelfth connectors join the second section to the fourth section;

the thirteenth and fourteenth connectors joins the second section to the fifth section;

the fifteenth and sixteenth connectors joins the first section to the second section;

the seventeenth and eighteenth connectors join the sixth section to the seventh section;

the nineteenth and twentieth connectors join the fifth section to the sixth section;

the twenty-first and twenty-second connector join the seventh section to the eighth section; and the twenty-third and twenty-fourth connectors join the fifth section to the eighth section;

further wherein a first half of the connected object comprised of the first, second, fourth and third sections can be rotated about a circular line B with respect to the other half of the connected object comprised of the fifth, eighth, seventh, and sixth sections to change the sphere from the first configuration to a second configuration where each of the plurality of connectors connects the sections as previously mentioned except in the second configuration:

the first connector and the fourteenth connector join the fifth and the first sections;

the second connector and the fifth connector join the third and sixth sections;

the sixth connector and the ninth connector join the fourth and the seventh sections; and the thirteenth connector and the tenth connector join the second and the eighth sections.

17. An apparatus comprising a plurality of sections comprised of a first section and a second section, the plurality of sections together forming a connected object;

a first connector which joins the first section to the second section;

wherein the first connector allows the first section to move with respect to the second section;

wherein the plurality of sections is further comprised of third, fourth, fifth, sixth, seventh, and eighth sections;

further comprising a plurality of connectors which is comprised of the first connector and second, third, fourth, fifth, sixth, seventh, eighth, ninth, tenth, eleventh, twelfth, thirteenth, fourteenth, fifteenth, sixteenth, seventeenth, eighteenth, nineteenth, twentieth, twenty-first, twenty-second, twenty-third, and twenty-fourth connectors;

wherein in a first configuration of the connected object:

the first and second connectors join the first section to the sixth section;

the third and fourth connectors join the first section to the third section;

the fifth and sixth connectors join the third section to the seventh section;

the seventh and eighth connectors join the third section to the fourth section;

the ninth and tenth connectors join the fourth section to the eighth section;

the eleventh and twelfth connectors join the second section to the fourth section;

the thirteenth and fourteenth connectors joins the second section to the fifth section;

the fifteenth and sixteenth connectors joins the first section to the second section;

the seventeenth and eighteenth connectors join the sixth section to the seventh section;

the nineteenth and twentieth connectors join the fifth section to the sixth section;

the twenty-first and twenty-second connector join the seventh section to the eighth section; and the twenty-third and twenty-fourth connectors join the fifth section to the eighth section;

further wherein a first half of the connected object comprised of the third, fourth, seventh, and eight sections can be rotated about a circular line C with respect to the other half of the connected object comprised of the first, second, fifth, and sixth sections to change the connected object from the first configuration to a second configuration where each of the plurality of connectors connects the sections as previously mentioned except in the second configuration:

the fourth connector and the seventeenth connector join the first section and the seventh section;

the eleventh section and the twenty-fourth section join the fifth section and the fourth section;

the twelfth connector and the third connector join the second section with the third section; and the twenty-third section and the eighteenth connector join the sixth section with the eighth section.

* * * * *